US007991337B2

(12) United States Patent
Watanabe et al.

(10) Patent No.: US 7,991,337 B2
(45) Date of Patent: Aug. 2, 2011

(54) IMAGE HEATING APPARATUS

(75) Inventors: Koki Watanabe, Moriya (JP); Daijiro Kato, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/558,921

(22) Filed: Sep. 14, 2009

(65) Prior Publication Data

US 2010/0008705 A1 Jan. 14, 2010

Related U.S. Application Data

(62) Division of application No. 11/359,411, filed on Feb. 23, 2006, now Pat. No. 7,610,006.

(30) Foreign Application Priority Data

Mar. 8, 2005 (JP) ..... 2005-063891

(51) Int. Cl.
*G03G 15/20* (2006.01)

(52) U.S. Cl. ..... 399/328

(58) Field of Classification Search ..... 399/328, 399/330

See application file for complete search history.

(56) References Cited

U.S. PATENT DOCUMENTS

| | | | | |
|---|---|---|---|---|
| 5,822,669 | A | 10/1998 | Okabayashi et al. | 399/330 |
| 6,097,926 | A * | 8/2000 | Takagi et al. | 399/328 |
| 6,687,481 | B2 | 2/2004 | Watanabe et al. | 399/328 |
| 7,099,616 | B2 | 8/2006 | Kato et al. | 399/328 |
| 2006/0081614 | A1 | 4/2006 | Nami et al. | 219/619 |

FOREIGN PATENT DOCUMENTS

JP 10-74009 3/1998

* cited by examiner

*Primary Examiner* — David M Gray
*Assistant Examiner* — Andrew V Do
(74) *Attorney, Agent, or Firm* — Fitzpatrick, Cella, Harper & Scinto

(57) ABSTRACT

An image heating apparatus of electromagnetic induction heating-type capable of providing a proper relative heat-generation distance with a magnetic flux generation member even when the magnetic flux generation member is bent by its own weight or thermally deformed includes at least an exciting coil, a holder for holding the exciting coil, and a rotatable fixation roller for generating heat by magnetic flux from the exciting coil to heat a material to be heated. The holder has an outer diameter $\phi d1$ at a central portion and an outer diameter $\phi d2$ at an end portion in a longitudinal direction of the holder perpendicular to a conveyance direction of the material to be heated. The outer diameters $\phi d1$ and $\phi d2$ satisfies: $\phi d1<\phi d2$.

7 Claims, 18 Drawing Sheets

IMAGE HEATING APPARATUS

This is a division of U.S. patent application Ser. No. 11/359,411, filed Feb. 23, 2006.

FIELD OF THE INVENTION AND RELATED ART

The present invention relates to an image heating apparatus for heating an image on a recording material by an electromagnetic induction heating method. More specifically, the present invention relates to a gloss-imparting apparatus for an image on the recording material and a fixing apparatus for fixing an image on the recording material.

In a fixing apparatus which employs an electromagnetic induction heat generation member as a heat generation member (heating member) and heats a material to be heated by Joule heating based on an eddy current generated in the electromagnetic heat generation member by causing magnetic flux (alternating magnetic flux) generated by a magnetic flux (magnetic field) generation means to act on the electromagnetic induction heat generation member, a heating apparatus of an electromagnetic induction heating-type is an apparatus for heating-fixing an unfixed toner image on a surface of a recording material by applying heating to the recording material on which the unfixed toner image is formed and carried.

Japanese Laid-open Patent Application Hei 10-74009 discloses a fixing apparatus of an electromagnetic induction heating-type. This fixing apparatus comprises: a metal sleeve as an induction heat generation member and an elastic pressure roller, which is kept pressed upon the metal sleeve in parallel to the metal sleeve to be rotated; and a coil assembly as a magnetic flux generating means is nonrotatively disposed in the metal sleeve. A high frequency current is passed through the coil of the coil assembly to generate a high frequency magnetic field, so that the metal sleeve is caused to generate heat by induction heating. The recording material bearing an unfixed toner image is introduced into, and conveyed through, a pressure nip portion between the metal sleeve and the elastic pressure roller, and at the pressure nip portion, the unfixed toner image on the recording material is thermally fixed to the surface of the recording material by the heat from the metal sleeve.

In the electromagnetic induction heating-type heating apparatus, a heat exchange efficiency is higher as a gap (clearance) between the magnetic flux generation means and the induction heat generation member is smaller. For this reason, it is desirable that they are accurately kept at a relative position where they are located as close as possible while ensuring such a gap therebetween that they do not contact each other.

However, the magnetic flux generation means is gradually thermally deformed in a gravitational direction with use due to its own weight and heat generated by the induction heating member. For this reason, the magnetic flux generation means and the induction heating member are in contact with each other, so that there has arisen such a problem that they rub against each other to cause wearing and noise.

SUMMARY OF THE INVENTION

An object of the present invention is to provide an electromagnetic induction heating-type image heating apparatus less liable to cause contact of magnetic flux generation means with a heat generation member even when the magnetic flux generation means is bent by its own weight or thermally deformed in the case of adopting such a constitution that the magnetic flux generation means and the heat generation member are caused to approach each other to improve.

According to an aspect of the present invention, there is provided an image heating apparatus, comprising:

magnetic flux generation means for generating magnetic flux;

a heat generation member for generating heat by an action of magnetic flux generated by the magnetic flux generation means to heat an image on a recording material; and a holder, disposed close to the heat generation member, for supporting the magnetic flux generation means; the holder comprising portions to be supported at both end portions in a longitudinal direction of the holder and a recessed portion recessed inwardly at least at a central portion in the longitudinal direction of the holder.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the present invention will be described in detail with reference to the drawings.

Embodiments

(1) Example of Image Forming Apparatus

Figure 1:
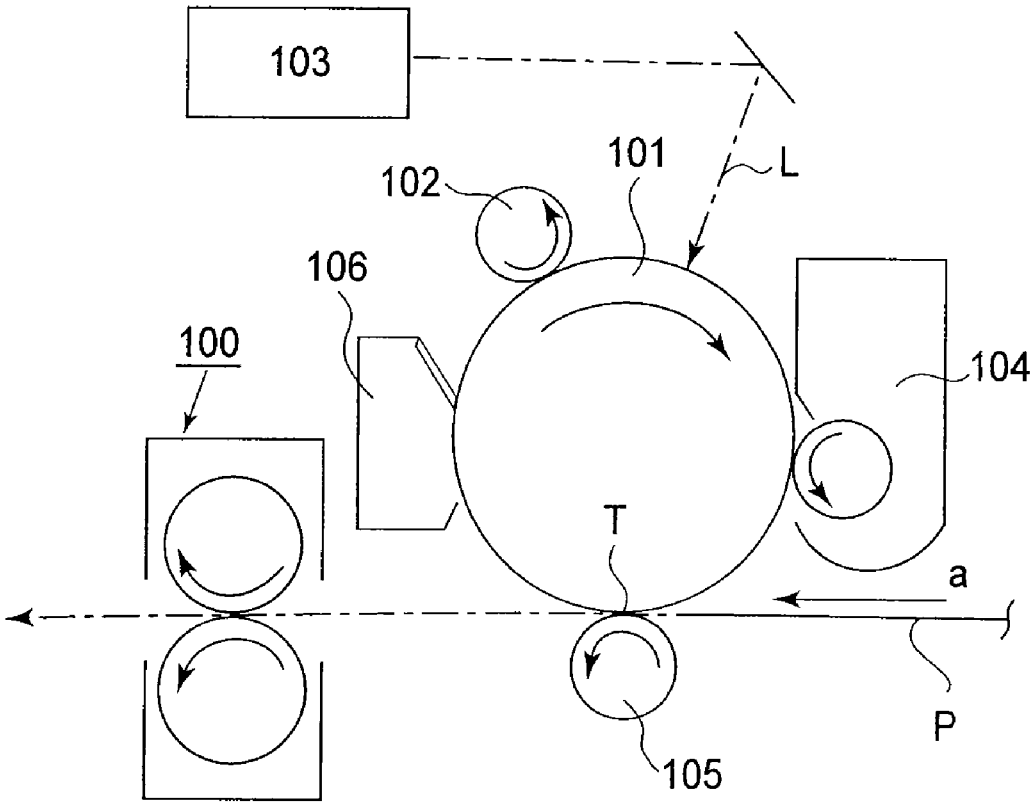
FIG. 1 is a schematic sectional view of an embodiment of an image forming apparatus.

FIG. 1 is a schematic view showing an example of an image forming apparatus employing a heating apparatus, as a thermal image fixing apparatus (hereinafter referred to as a "fixing apparatus"), in accordance with the present invention, which uses the heating method based on electromagnetic induction, showing the general structure thereof. An image forming apparatus 100 of this embodiment is a laser printer, which uses a transfer-type electrophotographic process.

Designated by referential numeral 101 is an electrophotographic photosensitive member (hereinafter referred to as "a photosensitive drum") as an image bearing member, which is rotationally driven in the clockwise direction indicated by an arrow, at a predetermined peripheral speed.

Designated by a referential numeral 102 is a charge roller, as a charging means, of the contact type, which uniformly charges electrically the peripheral surface of the photosensitive drum 101 to predetermined polarity and a potential level as the photosensitive drum 101 is rotated.

Designated by a referential numeral 103 is a laser scanner as an exposing means, which scans the uniformly charged peripheral surface of the photosensitive drum 101 by emitting a beam of laser light L while modulating it with time-sequential digital electrical signals corresponding to image information, as the photosensitive drum 101 is rotationally driven. As a result, an electrostatic latent image is formed in a pattern corresponding to a scanning exposure pattern on the peripheral surface of the photosensitive drum 101.

Designated by a referential numeral 104 is a developing apparatus, which normally or reversely develops the electrostatic latent image on the peripheral surface of the photosensitive drum 101, into a toner image.

Designated by a referential numeral 105 is a transfer roller as a transferring means, which is pressed against the peripheral surface of the photosensitive drum 101 at a predetermined pressing force to form a transfer nip (portion) T, to which a recording material P as a material to be heated is conveyed from an unshown sheet feeding/conveying mechanism at a predetermined control timing, and then, is conveyed through the transfer nip T while being pinched by the photosensitive drum 101 and transfer roller 105. A predetermined transfer bias is applied to the transfer roller 105 at a predetermined control timing. As a result, the toner image on the peripheral surface of the photosensitive drum 101 is electrostatically transferred successively onto the surface of the recording material P.

After being conveyed out of the transfer nip T, the recording material P is separated from the peripheral surface of the photosensitive drum 101, and introduced into the fixing apparatus 100, which fixes the unfixed toner image on the recording material P by applying heat and pressure to the introduced recording material and the unfixed toner image thereon; it turns the unfixed image into a permanent image. After being fixed, the recording material P is conveyed out of the fixing apparatus.

Designated by a referential numeral 106 is a device for cleaning the photosensitive drum 101, which removes the transfer residual toner remaining on the peripheral surface of the photosensitive drum 101 after the separation of the recording material P from the peripheral surface of the photosensitive drum 101. After the cleaning of the peripheral surface of the photosensitive drum 101, the peripheral surface of the photosensitive drum 101 is repeatedly subjected to subsequent image formation.

The direction indicated by a referential symbol a is the direction in which the recording material P is conveyed. As for the positioning of the recording material P relative to the main assembly of the image forming apparatus, in terms of the direction perpendicular to the recording material conveyance direction a, the recording medium P is conveyed through the main assembly so that the center line of the recording material P is kept aligned with the center of the fixing roller (center line-based sheet passing standard).

(2) Fixing Apparatus 100

Figure 2:
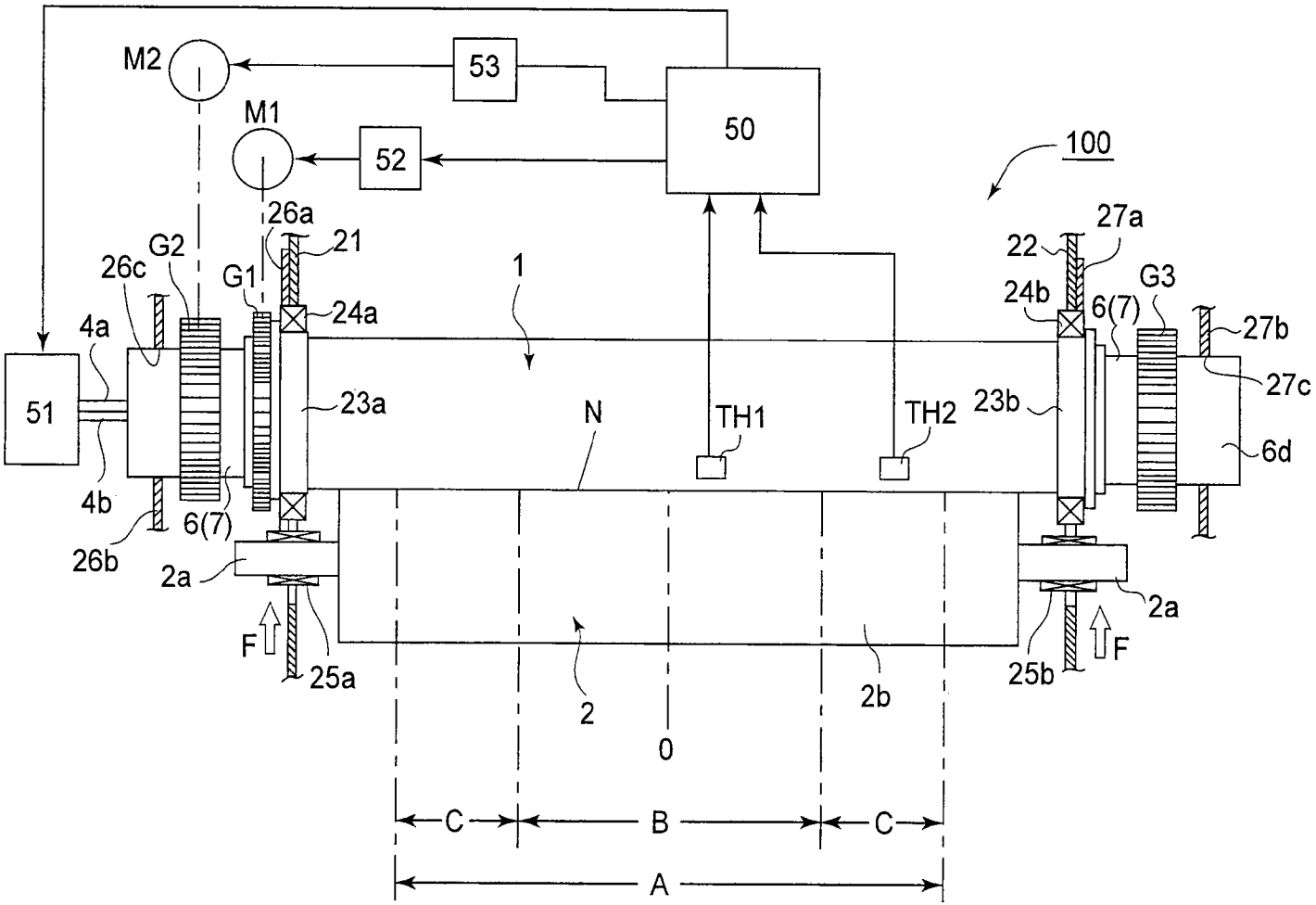
FIG. 2 is a schematic front view of a principal portion of a fixing apparatus.
Figure 3:
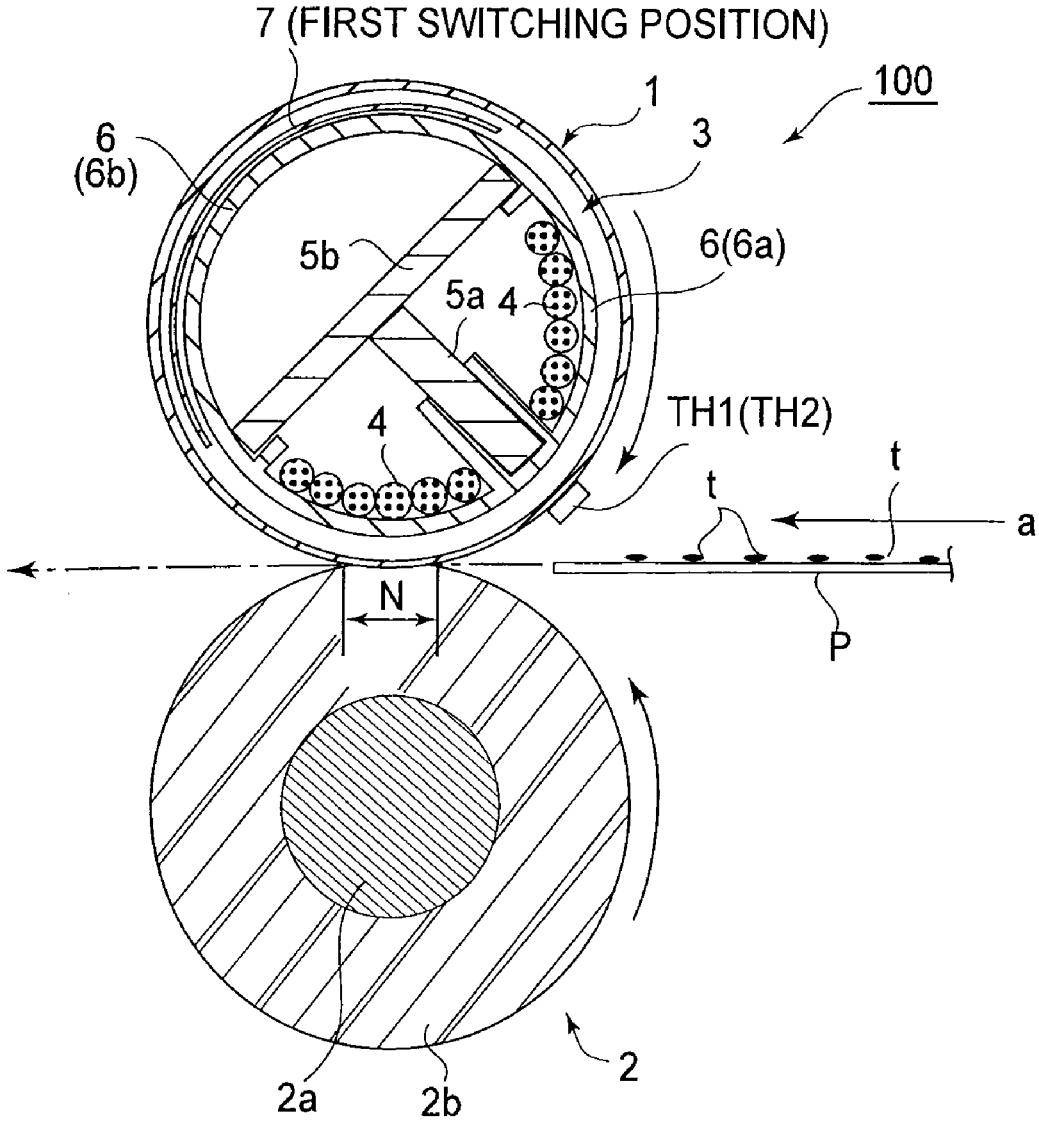
FIG. 3 is a schematic enlarged cross-sectional view of the principal portion of the fixing apparatus.
Figure 4:
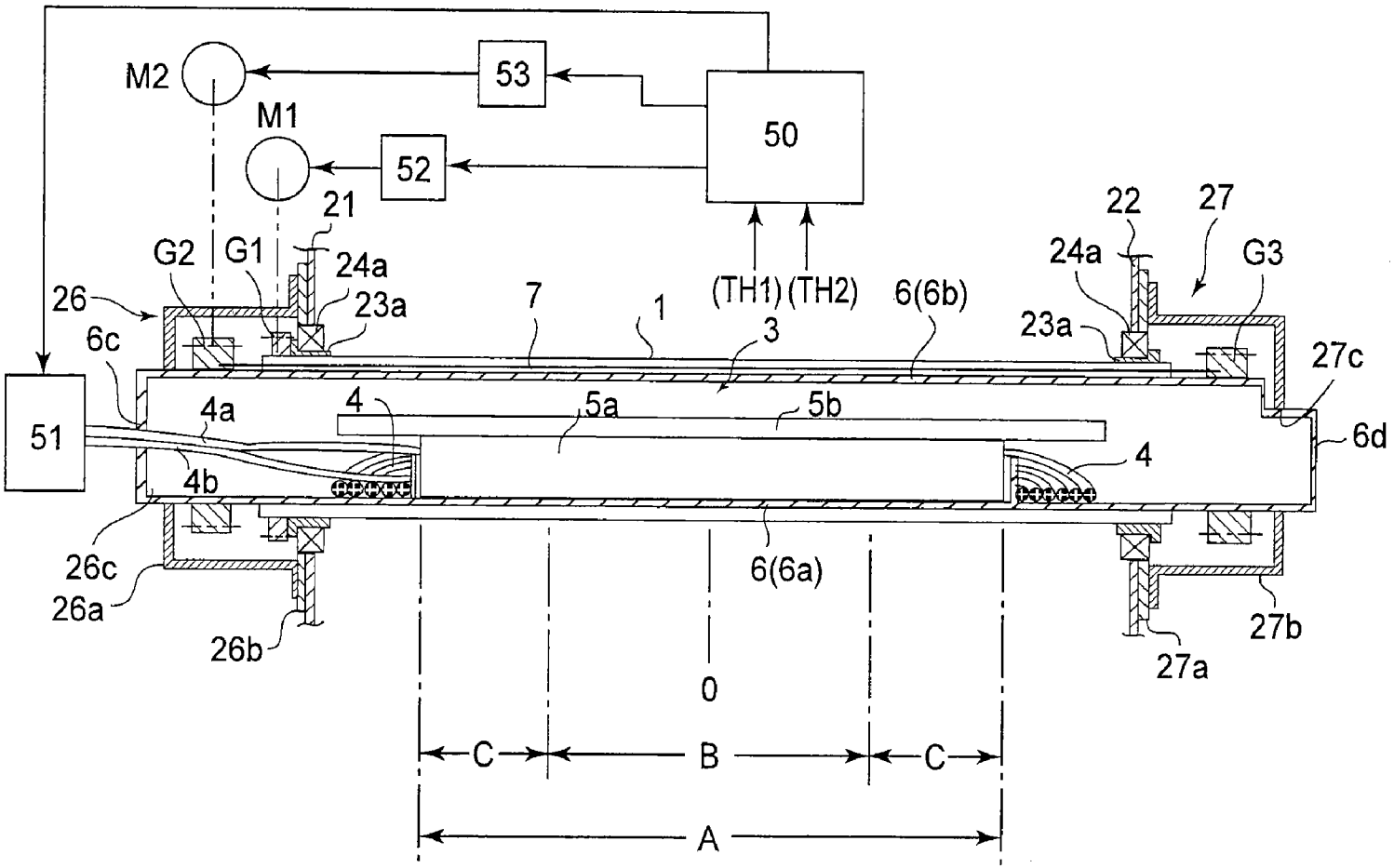
FIG. 4 is a schematic longitudinal sectional view of a fixing roller assembly portion.

FIG. 2 is a schematic front view of a principal portion of the fixing apparatus, and FIG. 3 is an enlarged schematic cross-sectional view of the principal portion of the fixing apparatus. FIG. 4 is a schematic longitudinal sectional view of the fixing roller assembly portion of the fixing apparatus.

For improving a degree of accuracy at which the fixation roller, as a member in which heat can be generated by electromagnetic induction, is positioned relative to an exciting coil assembly, the fixing apparatus in this embodiment is configured so that the fixation roller and exciting coil assembly are coaxially supported by the positioning members, inclusive of means for accurately positioning the supporting member for rotatably supporting the fixation roller and means for accurately positioning the exciting coil assembly.

Designated by a referential numeral 1 is a fixation (fixing) roller as an induction heat generation member. The fixation roller 1 is formed of such a material as iron, nickel, and SUS 430 (electrically conductive magnetic material), in which heat can be generated by electromagnetic induction. It is a cylindrical, and the thickness of its wall is in the range of 0.1 mm-1.5 mm. Generally, it comprises a release layer as the surface layer, or the combination of a release layer, an elastic layer, etc. Using one of the ferromagnetic metals (metallic substances with high level of permeability), as the material for the fixation roller, makes it possible to confine a larger portion of the magnetic flux generated from the magnetic flux generating means, in the wall of the fixation roller 1. In other words, it makes it possible to increase the fixation roller in magnetic flux density, making it thereby possible to more efficiently induce an eddy current in the surface portion of the metallic fixation roller.

This fixing apparatus 100 is provided with a front plate 21, a rear plate 22, a front fixation roller supporting member 26 (fixation roller positioning plate), a rear fixation roller supporting member 27 (fixation roller positioning plate). To the fixation roller supporting members 26 and 27, first supporting portions 26*a* and 27*a* are attached, respectively. The fixation roller 1 is provided with a pair of heat insulating bushings 23*a* and 23*b*, which are fitted around the lengthwise end portions of the fixation roller 1. It is rotatably supported at the front and rear lengthwise end portions by the portions 26*a* and 27*a* of the front and rear supporting members 26 and 27, with the interposition of bearings 24*a* and 24*b* disposed between the bushing 23*a* and the portion 26*a* of the front supporting member 26, and between the bushing 23*b* and portion 27*a* of the rear supporting member 27, respectively.

Figure 7:
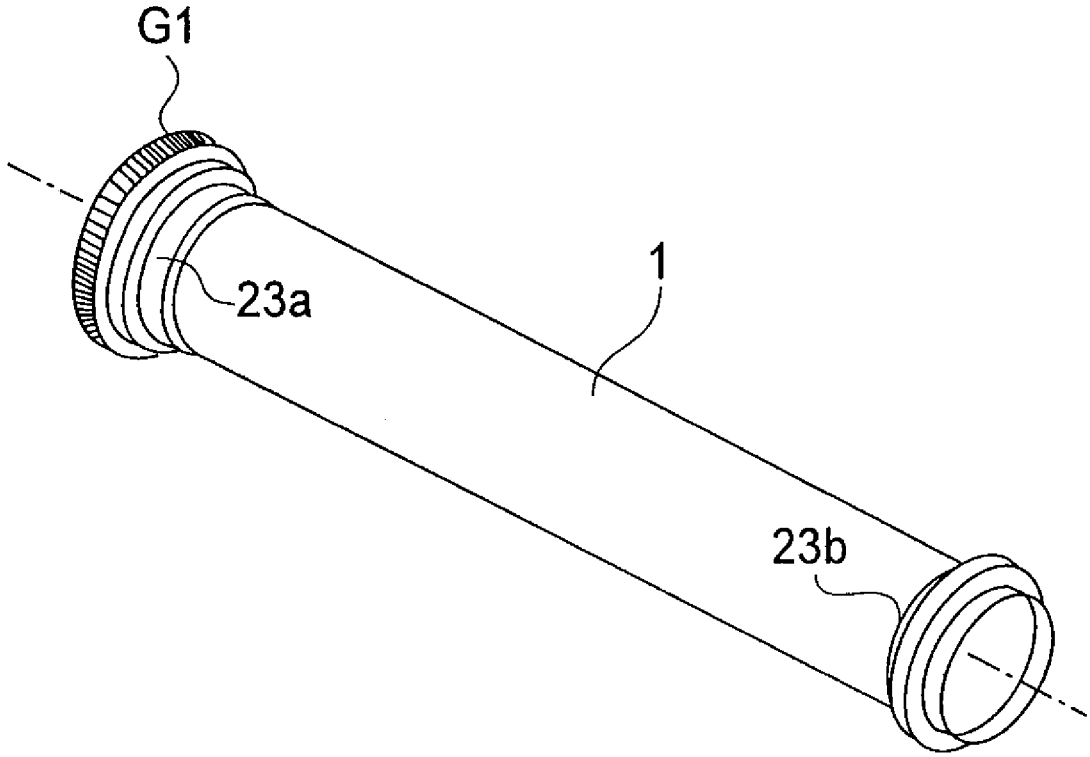
FIG. 7 is an external perspective view of the fixation roller to which the thermally insulating bushings and fixation roller gear have been attached.

The heat insulating bushings 23*a* and 23*b* are employed to minimize the heat transmission from the fixation roller 1 to the bearings 24*a* and 24*b*. Designated by a referential symbol G1 is a fixation roller driving gear fitted fast around the front end portion of the fixation roller 1. As the rotational force from a first motor M1 is transmitted to this gear G1 through a driving force transmission system (unshown), the fixation roller 1 is rotationally driven at a predetermined peripheral speed in the clockwise direction indicated by an arrow in FIG. 3. FIG. 7 is an external perspective view of the fixation roller 1 fitted with the pair of heat insulating bushings 23*a* and 23*b* and the fixation roller gear G1.

Designated by a referential numeral 2 is a pressure roller as a pressure (applying) member, which is an elastic roller made up of a metallic core 2*a*, a cylindrical elastic layer 2*b* fitted integrally and concentrically around the metallic core 2*a*, etc. The elastic layer 2*b* is a layer formed of a rubbery substance, for example, silicone rubber, which has the releasing property and is heat resistant. This pressure roller 2 is disposed under the fixation roller, in parallel with the fixation roller, being rotatably supported by the front and rear end portions of the metallic core 2*a*, with a pair of bearings 25*a* and 25*b* attached to the front and rear plates 21 and 22, respectively, in such a manner that they can be slide toward the fixation roller 1. Further, the bearings 25*a* and 25*b* are kept pressured upward toward the fixation roller 1 by a pair of urging means (unshown). With the provision of the above-described structural arrangement, the pressure roller 2 is pressed against the downwardly facing portion of the peripheral surface of the fixation roller 1, so that a predetermined pressing force F is applied between the fixation roller 1 and pressure roller 2 against the elasticity of the elastic layer 2*b*. As a result, a fixation nip N, as a heating nip, with a predetermined width is formed between the fixation roller 1 and pressure roller 2. As the fixation roller 1 is rotationally driven, the pressure roller 2 is rotated by the friction which occurs between the fixation roller 1 and pressure roller 2 in the fixation nip N.

Figure 8:
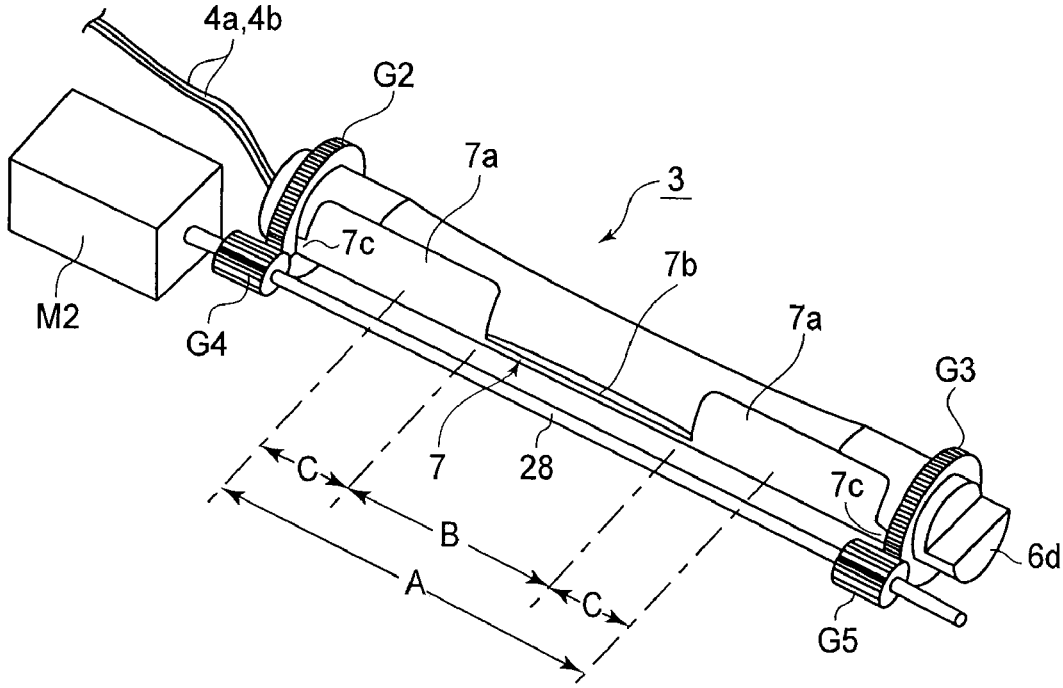
FIG. 8 is an external perspective view of the exciting coil assembly and the means for moving the magnetic flux adjusting member.
Figure 9:
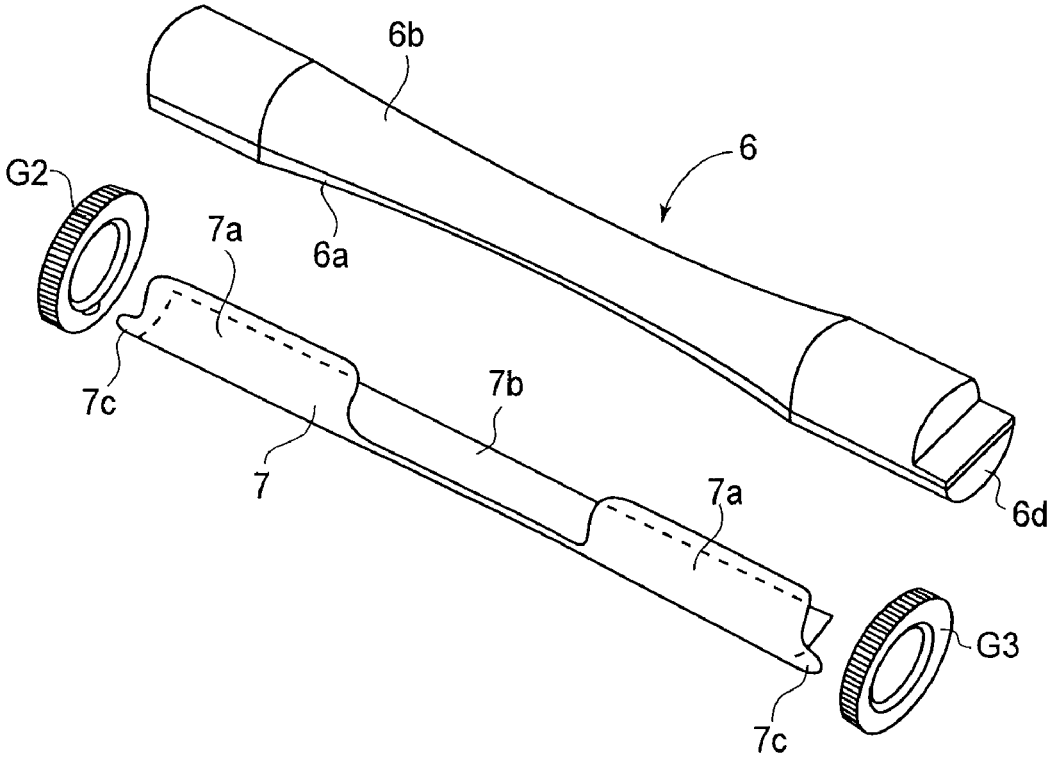
FIG. 9 is an exploded perspective view of the holder and magnetic flux adjusting member.
Figure 10:
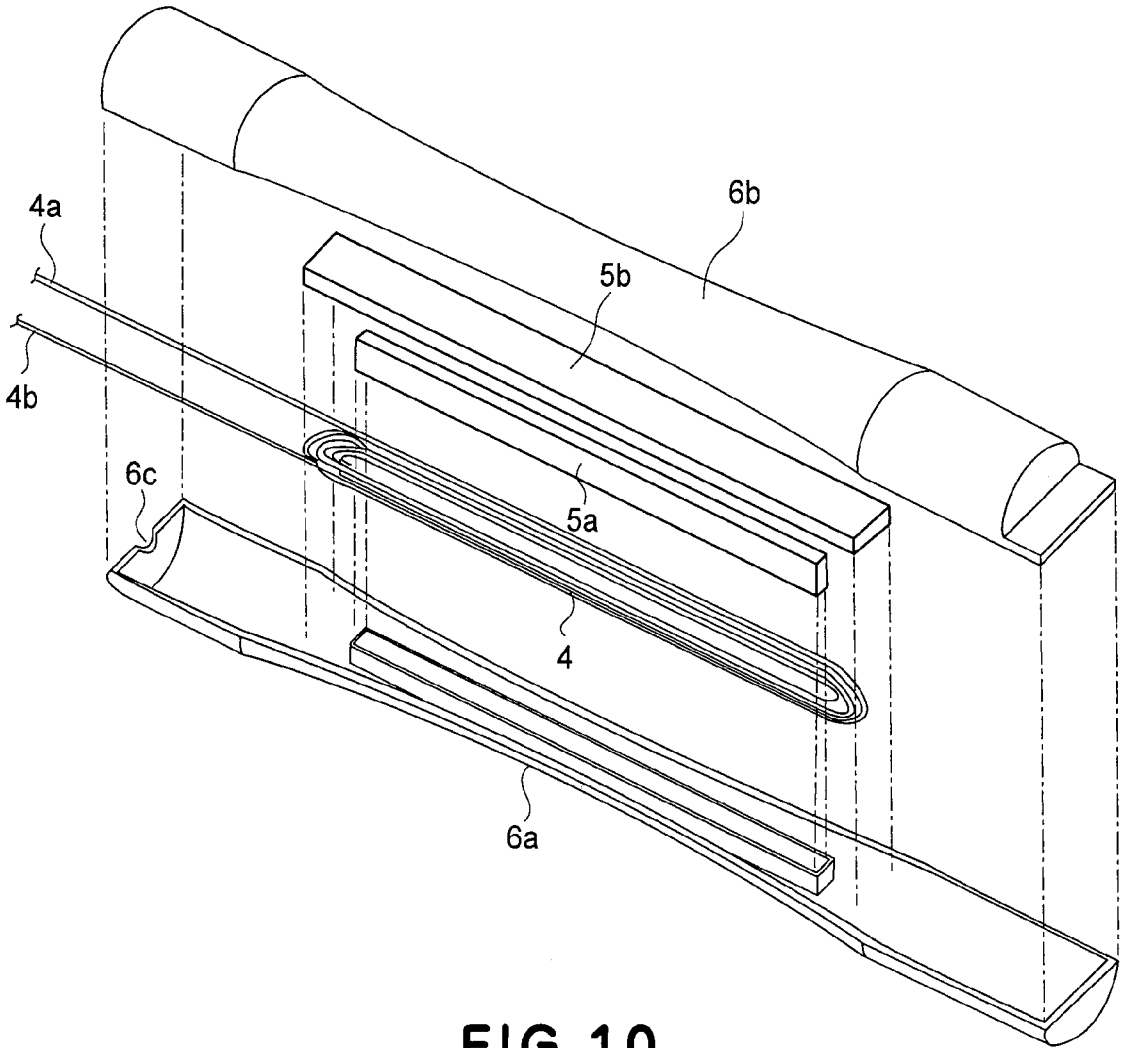
FIG. 10 is an exploded perspective view of the holder and the components therein.

Designated by a referential numeral 3 is an exciting coil assembly. This exciting coil assembly 3 is disposed in the hollow of the above-mentioned cylindrical fixation roller 1. The exciting coil assembly 3 is made up of an exciting coil 4 as a magnetic flux generation means, magnetic cores 5*a* and 5*b*, and a holder 6. The magnetic cores 5*a* and 5*b* are integrally attached to each other, yielding a component with a T-shaped cross section, and are disposed in the hollow of the holder 6. The exciting coil assembly is also provided with a magnetic flux adjusting member 7 (magnetic flux shielding member: shutter), which is rotatably disposed on the outward side of the holder 6, coaxially with the holder 6. FIG. 8 is an external perspective view of this exciting coil assembly 3 and the magnetic flux adjusting member moving means M2, 28, G4 and G5. FIG. 9 is an exploded perspective view of the holder 6 and the magnetic flux adjusting member 7. FIG. 10 is an exploded perspective view of the holder 6 and components therein.

Hereinafter, the lengthwise (longitudinal) direction of the structural components or the portions thereof of the fixing apparatus means the direction perpendicular to the recording material conveyance direction a.

The holder 6 is roughly cylindrical in cross section, from one lengthwise end to the other. As the material therefor, a mixture of PPS resin, which is heat resistant and has mechanical strength, and glass fiber, is used. As for the substances, other than the PPS resin, suitable as the material for the holder 6, PEEK resin, polyimide resin, polyamide resin, polyamide-imide resin, ceramic, liquid polymer, fluorinated resin, and the like are available.

Referring to FIG. 10, the holder 6 is made up of two (first and second) roughly semicylindrical portions 6*a* and 6*b*, which are attached to each other with adhesive, or are interlocked to each other by providing the two portions 6*a* and 6*b* with such a shape that makes it possible to interlock the two portions 6*a* and 6*b* with each other, to form the holder 6, which is roughly cylindrical, from one lengthwise end to the other. The coil 4 and cores 5*a* and 5*b* are disposed in the first semicylindrical portion 6*a*, and then, the second semicylindrical portion 6*b* is bonded to the first semicylindrical portion 6*a* in a manner of encasing the coil 4 and core 5*a* and 5*b*, completing the holder 6 which internally holds the coil 4 and core 5*a* and 5*b*. Designated by referential numerals 4*a* and 4*b* are lead wires, which are extended outwardly from the holder 6 through a hole 6*c* of the front end wall of the holder 6.

Also as shown in FIG. 10, the coil 4 has a roughly elliptical shape (shape of long and narrow boat), the major axis of which is parallel with the lengthwise direction of the fixation roller 1. It is disposed in the hollow of the first semicylindrical portion 6*a* of the holder 6 so that its external contour follows the internal surface of the fixation roller 1. The coil 4 must be capable of generating an alternating magnetic flux strong enough to generate a sufficient amount of heat for fixation. Therefore, the coil 4 must be small in electrical resistance, and high in inductance. As the wire for the coil 4, Litz wire is used, which is made by bundling roughly 80-160 strands of fine wires, the diameter of which is in the range of 0.1-0.3 mm. The Litz wire is wound 6-12 times around the first core 5*a*.

The core 5*a* constitutes a first core (equivalent to vertical portion of T-shape) around which the Litz wire is wound. The core 5*b* constitutes a second core (equivalent to horizontal portion of T-shape). The two cores 5*a* and 5*b* are attached to each other so that the resultant component will be T-shaped in cross section. As the material for the cores 5*a* and 5*b*, such a substance as ferrite that is high in permeability, and yet, is low in residual magnetic flux density, is preferable. However, the only requirement for the material for the cores 5*a* and 5*b* is that the material is capable of generating magnetic flux. In other words, what is required of the material for the cores 5*a* and 5*b* is not particularly restrictive. Further, the cores 5*a* and 5*b* are not required to be in a specific form, or be made of a specific material. Moreover, the first and second core 5*a* and 5*b* may be integrally formed in a single piece magnetic core, which is T-shaped in cross section.

Referring to FIG. 9, the magnetic flux adjusting member 7 is shaped so that its cross section is arcuate, from one lengthwise end to the other. It has a pair of broader shutter portions 7*a* and 7*a* having the arcuate cross section and a narrower connective portion 7*b* which is disposed between the shutter portions 7*a* and 7*a* in a circumferential direction and have the arcuate cross section. As for the material for the magnetic flux adjusting member 7, such a nonferrous metallic substance as aluminum, copper, or the like is used, and among nonferrous metallic substances, those which are lower in electrical resistance are preferable. The magnetic flux adjusting member 7 is also provided with a pair of protrusions 7*c* and 7*c*, which protrude from the outward edges of the shutter portions 7*a* and 7*a*, one for one, in the lengthwise direction of the magnetic flux adjusting member 7. These protrusions 7*d* and 7*d* are engaged with the first and second shutter gears G2 and G3 rotatably fitted around the front and rear end portions of the holder 6. With the provision of the above described structural arrangement, the magnetic flux adjusting member 7 is held at its lengthwise ends by the first and second shutter gears G2 and G3, between the first and second shutter gears G2 and G3.

The fixing apparatus 100 is structured so that the holder 6 of the exciting coil assembly 3 is supported as shown in FIGS. 2 and 4. That is, one of the lengthwise end portions of the cylindrical holder 6 is extended outward beyond the front end of the fixation roller 1, through the front opening of the fixation roller 1, and is fitted in the hole 26*c* of the second portion 26*b* of the front supporting member 26 attached to the outward side of the front plate 21 of the fixing apparatus 100, being thereby supported by the front plate 21. The other lengthwise end portion of the holder 6 is extended outward beyond the rear end of the fixation roller 1, through the rear opening the fixation roller 1, and is fitted in the hole 27*c* of the second portion 27*b* of the rear supporting member 27 attached to the outward side of the rear plate 22 of the fixing apparatus 100, being thereby supported by the rear plate 22. More specifically, the rear end portion of the holder 6 is provided with a D-cut portion 6*d*, and the hole 27*c* of the rear supporting member 27 is D-shaped in cross section. Therefore, the holder 6 is nonrotationally supported by the front and rear plates 26 and 27 of the fixing apparatus 100. Also with the provision of the above-described structural arrangement, the holder 6 is disposed in the hollow of the fixation roller 1 so that the two are coaxially disposed while providing a predetermined amount of gap between the peripheral surface of the holder 6 and internal surface of the fixation roller 1, and also, so that the holder 6 is nonrotationally held in a predetermined attitude, that is, at a predetermined angle in terms of its circumferential direction. The afore-mentioned lead wires 4*a* and 4*b* extending outward from the holder 6 through the hole 6*c*, with which the front end wall of the holder 6 is provided, are connected to an excitation circuit 51.

Incidentally, regarding the means for nonrotationally holding the holder 6 at the aforementioned angle (position) in terms of its circumferential direction, in this embodiment, the D-cut end portion 6*d* of the holder 6 is fitted in the hole 27*c* of the portion 27*b* of the second supporting member 27, which is D-shaped in cross section. However, the means for nonrotationally holding the holder 6 at the predetermined angle (position) does not need to be limited to the above-described means. That is, any means will suffice as long as the holder 6 can be nonrotationally held at the predetermined angle (position) in terms of its circumferential direction.

As described above, the magnetic flux adjusting member 7 is supported between the first and second shutter gears G2 and G3, by being supported at both of its lengthwise ends by the gears G2 and G3. That is, the protrusions 7*c* and 7*c* (FIGS. 8 and 9), which are the actual lengthwise end portions of the magnetic flux adjusting member 7, are supported by the first and second shutter gears G2 and G3 by being engaged with the first and second shutter gears G2 and G3, respectively, which are rotatably fitted around the front and rear end portions of the holder 6. Thus, as the first and second shutter gears G2 and G3 are rotated by the means M2, 28, G4, and G5 for moving the magnetic flux adjusting member 7, the magnetic flux adjusting member 7 is rotated about the axial line of the holder 6, through the gap between the peripheral surface of the holder 6 and the internal surface of the fixation roller 1.

Referring to FIG. 8 which depicts the means M2, 28, G4, and G5 for moving the magnetic flux adjusting member 7, a referential symbol M2 stands for a second motor; 28: a shaft; G4: first output gear; and a referential symbol G5 stands for a second output gear. The shaft 28, which is located outside the fixation roller 1, is rotatably supported in parallel with the fixation roller 1, by the front and rear plate 22 of the fixing apparatus 100, with a pair of bearings (unshown) placed between the shaft 28 and the plates 22 and 23. The second motor M2 is a driving force source for rotating the shaft 28, and is a stepping motor. The first and second output gears G4 and G5 are rigidly and coaxially attached to the shaft 28. The first and second output gears G4 and G5 are meshed with the first and second shutter gears G2 and G3 of the exciting coil assembly 3, respectively. Thus, as the second motor M2 is rotationally driven, the rotational force is transmitted to the first and second shutter gears G2 and G3, causing thereby the magnetic flux adjusting member 7 to rotate about the axial line of the holder 6 in a manner to follow the peripheral surface of the holder 6. As for the material for the gears, one of the various resinous substances may be selected according to the ambient temperature, and the amount of torque to which they are subjected.

Referring to FIG. 2, designated by a referential numeral 50 is a control circuit portion (CPU), which activates the first motor M1 at a predetermined control timing, through a driver 52, according to an image formation sequence. As the first motor M1 is activated, the rotational force is given to the driving gear G1 of the fixation roller 1, rotationally driving the fixation roller 1 in the clockwise direction indicated by an arrow in FIG. 3. The pressure roller 2 is rotated by the rotation of the fixation roller 1.

The control circuit portion 50 also activates the exciting circuit 51 at a predetermined timing, supplying thereby the coil 4 with alternating electric current. As a result, an alternating magnetic flux (alternating magnetic field) is generated, and therefore, heat is generated in the wall of the fixation roller 1 by electromagnetic induction, causing the fixation roller 1 to increase in temperature.

Figure 6:
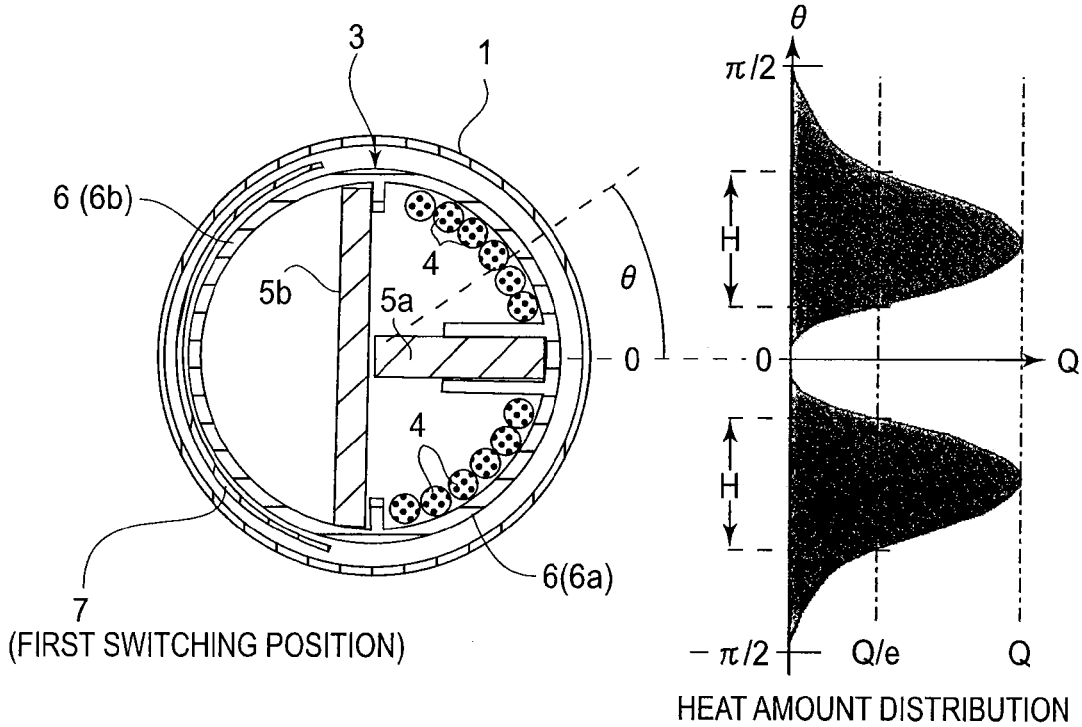
FIG. 6 is a view showing the primary area across which a magnetic flux is generated, and the heat distribution, corresponding to the primary area, in terms of the direction parallel with the circumferential direction of the fixation roller.

FIG. 6 is the combination of a schematic cross-sectional view of the fixation roller 1 in the system such as the above-described one, and a graph showing a distribution of amount of heat generation of the fixation roller 1 in the heated condition. It shows the areas to which the major portion of the magnetic flux generated by the magnetic flux generating means concentrates, and the corresponding heat distribution of the fixation roller 1, in terms of the circumferential direction of the fixation roller 1. As alternating electric current is flowed through the coil 4, the coil 4 generates an alternating magnetic flux. The fixation roller 1 is formed of a magnetic metal or a magnetic material. Within the wall of the fixation roller 1, induced current (eddy current) is induced in a manner to neutralize the magnetic field. This induced current generates heat (Joule heat) in the wall of the fixation roller 1, thereby increasing the temperature of the fixation roller 1.

In the case of the structure of the fixing apparatus in this embodiment, the area in which the magnetic flux is principally generated is on the outward side of the first semicylindrical portion 6*a* of the holder 6, in which the coil 4 and cores 5*a* and 5*b* are disposed. Thus, the portion of the fixation roller 1, which is in this magnetic flux generation area, is where heat is generated by the magnetic flux. The heat distribution of the fixation roller 1, in terms of the circumferential direction of the fixation roller 1, across the portion in the above-mentioned magnetic flux generation area, has two areas H and H, in which most of the heat is generated, as shown in FIG. 6. In this embodiment, the holder 6 is nonrotationally held (positioned) at such an angle in terms of the circumferential direction of the holder 6 that the portion of the coil 4, which corresponds to one of the two areas H and H, faces the fixation nip portion N, and the portion of the coil 4, which corresponds to the other of the two areas H and H, faces the immediate adjacencies of the fixation nip portion N on the upstream side in terms of the rotational direction of the fixation roller 1.

When the magnetic flux adjusting member 7, which is in the gap between the outer surface of the holder 6 and the inner surface of the fixation roller 1, is not required to adjust the magnetic flux, it is moved into, and kept in, the position shown in FIGS. 3 and 6, which is on the opposite side of the fixing apparatus from the afore-mentioned areas in which the magnetic flux is generated. This area is where an effective magnetic flux from the magnetic flux generating means does not substantially act on the fixation roller 1 or extremely low in density. This position shown in FIGS. 3 and 6 will be referred to as a "first switching position". The temperature of the fixation roller 1 is detected by a central thermistor TH1 as a temperature detecting means, disposed at the roughly midpoint of the fixation roller 1 in terms of the lengthwise direction thereof, in contact, or with no contact, with the fixation roller 1, and the detected temperature is inputted into the control circuit 50, which controls the temperature of the fixation roller 1 by controlling the electric power supplied from the exciting circuit 51 to the coil 4, so that the fixation roller temperature detected by the central thermistor TH1 and inputted into the control circuit 50 remains at a predetermined target temperature (fixation temperature). While the magnetic flux adjusting member 7 is kept in the first position shown in FIGS. 3 and 6, the fixation roller 1 is controlled in temperature so that the temperature of the fixation roller 1 is kept at the target level across the entirety of its effective range (heatable range) in terms of its lengthwise direction.

While the fixation roller temperature is kept at the predetermined fixation level after being raised thereto, a recording material P carrying an unfixed toner image t is introduced into the fixation nip portion N, and is conveyed through the fixation nip portion N while being kept pinched by the fixation roller 1 and pressure roller 2. As the recording material P is conveyed through the fixation nip N, the unfixed toner image t on the recording material P is fixed to the surface of the recording material P by the heat from the fixation roller 1 and the pressure at the fixation nip portion N.

Hereinafter, the term, a recording material width (sheet width or paper width) means the dimension of a recording material, in terms of the direction perpendicular to the recording material conveyance direction a, when the recording material P is completely flat. As described above, in this embodiment, the recording material P is conveyed through the fixing apparatus (image forming apparatus) so that the center of the recording material P in terms of its width direction coincides with the center of the fixing apparatus (fixation roller 1) in terms of the width direction of the recording material P (center line-based sheet passing standard). Referring to FIGS. 2 and 4, designated by a referential symbol O is the center line (hypothetical line), as the referential line, of the fixation roller 1 (recording material) in terms of its lengthwise direction, and designated by a referential symbol A is the width of the path of the largest recording material, in terms of width, usable with the image forming apparatus. Designated by a referential symbol B is the width of the path of a recording material which is smaller in size than the largest recording material. Hereinafter, a recording material smaller in width than the largest recording material will be referred to as a "small recording material". Designated by a referential symbol C are the areas between the edges of a large recording material and the edge of a small recording material.

In other words, each of the areas C shows a width of an area through which the recording material is not passed in the recording material conveyance path (non-sheet passing area). Since a recording material is conveyed through the fixing apparatus so that the center of the recording material in terms of its width direction coincides with the center of the fixation roller 1 in terms of its lengthwise direction, there will be two non-sheet-passing areas C, one on the left side of the path B of the small recording material, and the other on the right side of the path B of the small recording material. The width of the non-sheet-passing areas C is changed by the width of the small recording material being passed through the fixing apparatus.

The above-mentioned central thermistor TH1 used for controlling the temperature of the fixation roller 1 is disposed within the path B of the small recording material so that it will be within the path of a recording medium regardless of recording material width.

Designated by a referential symbol TH2 is a peripheral thermistor as a temperature detecting means disposed within one of the non-sheet-passing areas C of a recording material, in terms of the lengthwise direction of the fixation roller 1, in contact, or with no contact, with the fixation roller 1, in order to detect the increase in the temperature of the fixation roller 1, across the portions corresponding to the non-sheet-passing areas C. The temperature data obtained by this peripheral thermistor TH2 are also inputted into the control circuit portion 50.

When multiple small recording materials are consecutively conveyed through the fixing apparatus 100, the portions of the fixation roller 1 corresponding in position to the non-sheet-passing areas C increases in temperature, and this increase in temperature is detected by the peripheral thermistor TH2, and the detected increase in temperature is inputted from the thermistor TH2 to the control circuit portion 50. When the temperature level of the non-sheet-passing area C inputted into the control circuit portion 50 by the peripheral thermistor TH2 exceeds the predetermined permissible range, the control circuit portion 50 rotationally moves the magnetic flux adjusting member 7 from the first position shown in FIGS. 3 and 6 into the second position shown in FIG. 5 by activating the second motor M2 through the driver 53.

The second switching position for the magnetic flux adjusting member 7 is such a position that when the magnetic flux adjusting member 7 is in this position, the wider arcuate shutter portions 7*a* and 7*a* of the magnetic flux adjusting member 7 in its lengthwise direction are in the following positions. That is, the arcuate shutter portions 7*a* and 7*a* of the magnetic flux adjusting member 7 which is in the gap between the outer surface of the magnetic flux and the inner surface of the fixation roller 1, are placed in the portions of the above-described gap, one for one, which correspond in position to the non-sheet-passing areas C in terms of the lengthwise direction of the fixation roller 1.

With the magnetic flux adjusting member 7 placed in the second position, the magnetic flux from the magnetic flux generating means is reduced in the effective amount by which it acts on the portion of the fixation roller 1 which corresponds in position to the non-sheet-passing areas C. Therefore, the portions of the fixation roller 1 corresponding to the non-sheet-passing areas C are minimized in the amount by which heat is generated therein. Therefore, the problem of temperature rise in the non-sheet-passing area C is prevented.

Figure 5:
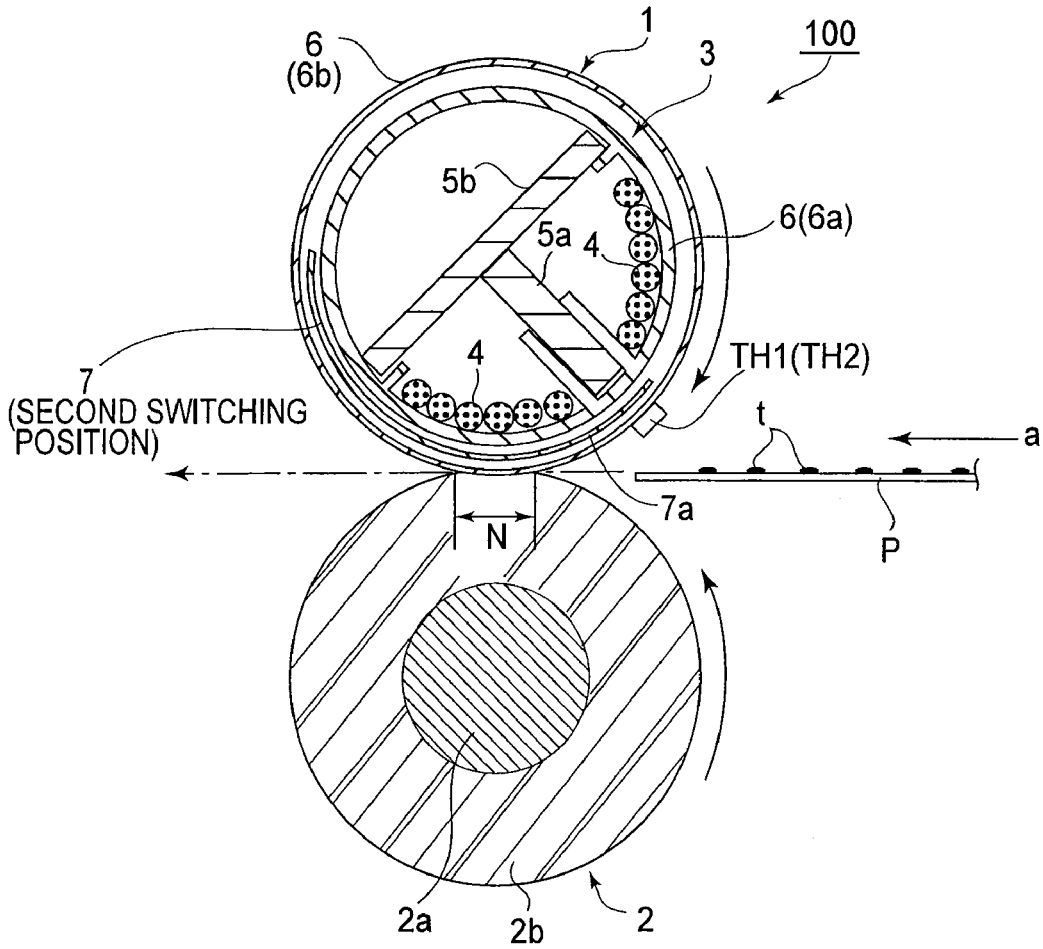
FIG. 5 is an enlarged schematic cross-sectional view of the essential portions of the fixing apparatus in the condition in which a magnetic flux adjusting member is being rotationally moved to a second switching position.

The shutter portions 7*a* and 7*a* and 7*b* and 7*b*, which correspond in position to the non-sheet-passing C, extend from one end of the magnetic flux generation area, in terms of the circumferential direction of the fixation roller 1 (holder 6), to the other, or a part of the way to the other. FIG. 5 shows the structural arrangement in which the shutter portions 7*a* and 7*a* extend from one end of the magnetic flux generation area halfway to the other.

As the magnetic flux adjusting member 7 is rotationally moved into the second switching position, the portions of the fixation roller 1 corresponding to the non-sheet-passing areas C gradually reduce in temperature. When the temperature level of these portions inputted into the control circuit portion 50 by the peripheral thermistor TH2 falls below the predetermined permissible level i.e., when an excessively decreased temperature in the non-sheet-passing areas is detected, the control circuit portion 50 rotationally moves the magnetic flux adjusting member 7 into the first switching position to prevent these portions of the fixation roller 1 from becoming too low in temperature.

Further, when an image forming operation which uses recording material of a small size is switched to an image forming operation which uses recording material of a large size after the magnetic flux adjusting member 7 is rotationally moved into the second switching position during the image forming apparatus using the recording materials of the small size, the control circuit portion 50 rotationally moves the magnetic flux adjusting member 7 back into the first switching position.

As described above, as the means for transmitting the force for driving the magnetic flux adjusting member 7, the front and rear lengthwise end portions of the holder 6 are fitted with the first and second shutter gears G2 and G3, which are rotatable around the holder 6. Further, the magnetic flux adjusting member 7 is provided with the afore-mentioned protrusions 7*c*, which protrude outward from the outward edges of the magnetic flux adjusting member 7. These protrusions 7*c* are engaged with the first and second shutter gears G2 and G3 so that the magnetic flux adjusting member 7 is supported at both of its lengthwise ends, between the gears G2 and G3, by the gears G2 and G3. The shutter gears G2 and G3 are engaged with (fitted around) the holder 6 by the portions which are not engaged with the protrusions 7*c* and 7*c* of the magnetic flux adjusting member 7. Therefore, the magnetic flux adjusting member 7 can be rotated by the gears G2 and G3, following the peripheral surface of the holder 6. The portion of the holder 6, around which the gear G2 is fitted, and the portion of the holder 6, around which the gear G3 is fitted, are rendered uniform in external diameter across the portions largest in external diameter. Here, the expression that the portions of the holder 6, around which the gears G2 and G3 are fitted, one for one, and are the largest in external diameter, means that the holder 6 may be reduced in weight. With the employment of this structural arrangement, as the holder 6 and magnetic flux adjusting member 7 are engaged with the gears G2 and G3, they are coaxially disposed, making it possible to improve the image heating apparatus in terms of the level of accuracy at which these components are positioned relative to each other.

Basically, the magnetic flux adjusting member 7 is arcuate in cross section from one lengthwise end to the other in terms of the lengthwise direction of the fixation roller 1. The lengthwise end portions of the magnetic flux adjusting member 7 are different in dimension from the center portion of the magnetic flux adjusting member 7. When a recording medium of a small size is conveyed through the fixing apparatus, the magnetic flux adjusting member 7 is rotated so that the shutter portions 7*a* and 7*a*, that is, the lengthwise portions, of the magnetic flux adjusting member 7 are moved into the areas where the magnetic flux is generated, in order to prevent the fixation roller 1 from increasing in temperature across the lengthwise end portions. Here, the constitution (structure) of the magnetic flux adjusting member 7 is not limited to that described above. For example, the magnetic flux adjusting member 7 may be configured to be provided with the shutter portions 7*a* which are disposed only at a central portion corresponding to the sheet passing area but are not disposed at end portions. In this case, an amount of magnetic flux at the central portion is decreased compared with that at the end portions by moving the magnetic flux adjusting member 7 to a predetermined magnetic flux adjusting position, so that an amount of heat generation in the sheet passing area in the longitudinal direction of the fixation roller can be changed so that its distribution is suppressed compared with that in the non-sheet-passing areas. Further, the above-described constitutions of the magnetic flux adjusting member may be used in combination.

Next, referring to FIGS. 11-13, the front and rear supporting members 26 and 27 for supporting the fixation roller 1 and holder 6 by their front and rear end portions, respectively, will be described in somewhat more detail.

The front and rear supporting members 26 and 27 are attached to the front and rear plates 21 and 22 of the fixing apparatus 100, with the use of small screws which are put through the roughly round hole 26*d* and elongated hole 26*e* of the front supporting member 26, and the corresponding holes of the front plate 21 of the fixation apparatus, and through the roughly round hole 27*d* and elongated hole 27*e* of the rear supporting member 27, and the corresponding holes of the rear plate 22 of the fixing apparatus. Therefore, the fixation roller 1 and holder 6 can be easily replaced by removing the small screws.

Figure 11:
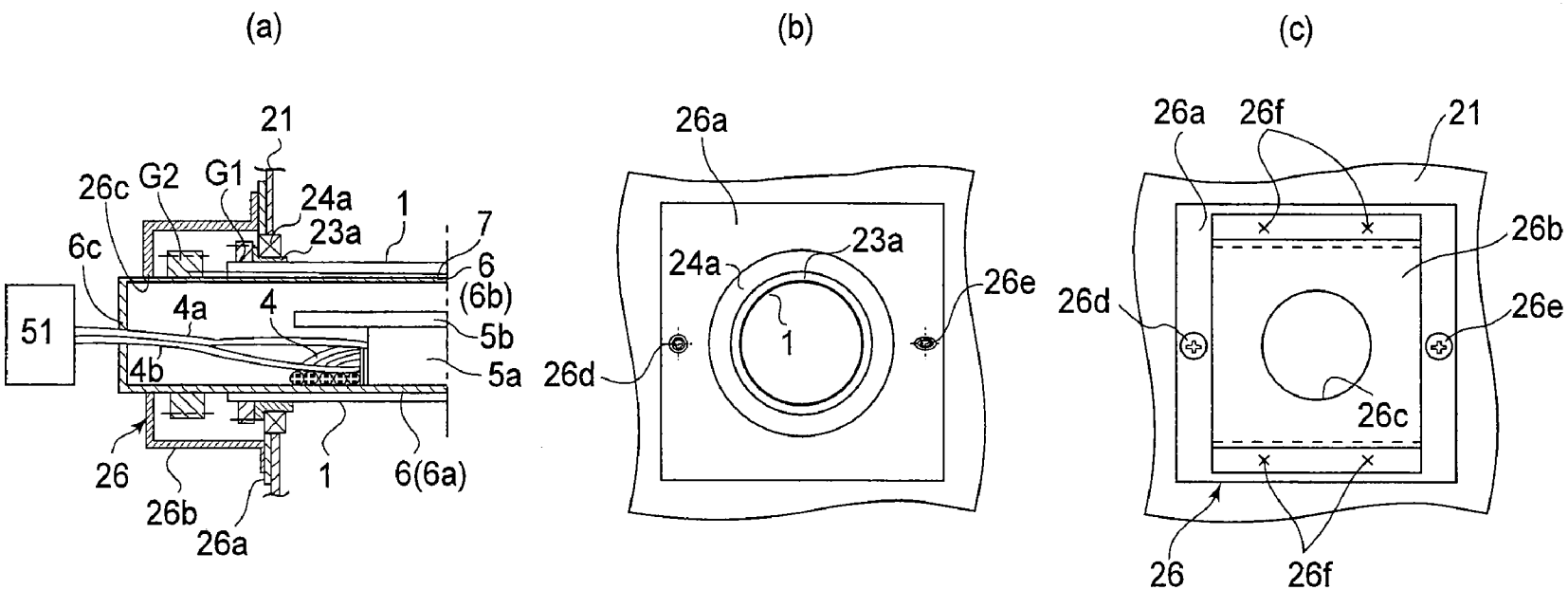
FIGS. 11(*a*), 11(*b*), and 11(*c*) are drawings showing a front supporting member for supporting the fixation roller and the holder, by their front end portions.

Referring to FIGS. 11(*a*), 11(*b*), and 11(*c*), the front supporting member 26 is made up of two portions: first and second portions 26*a* and 26*b*. The first portion 26*a* is provided with a round hole for supporting the bearing 24*a* by the front supporting member 26; the front end portion of the fixation roller 1 is fitted in this hole, with the heat insulating bushing 23*a* placed between the fixation roller 1 and the bearing 24*a*. The second portion 26*b* of the front supporting member 26 is provided with a round hole 26*c* for supporting the cylindrical front end portion of the holder 6.

Further, the first and second portions 26*a* and 26*b* of the front supporting member 26 are spot welded to each other at points 26*f*. As for the method for welding the two portions 26*a* and 26*b* to each other, the portions 26*a* and 26*b* are kept accurately positioned relative to each other with the use of a jig 61 as a means for facilitating the positioning of the portions 26*a* and 26*b* relative to each other, as shown in FIG. 13(*a*), and then, the two portions 26*a* and 26*b* are spot welded to each other. Therefore, it is possible to manufacture the front supporting member 26 capable of coaxially holding the fixation roller 1 and holder 6 at a high level of accuracy.

Figure 12:
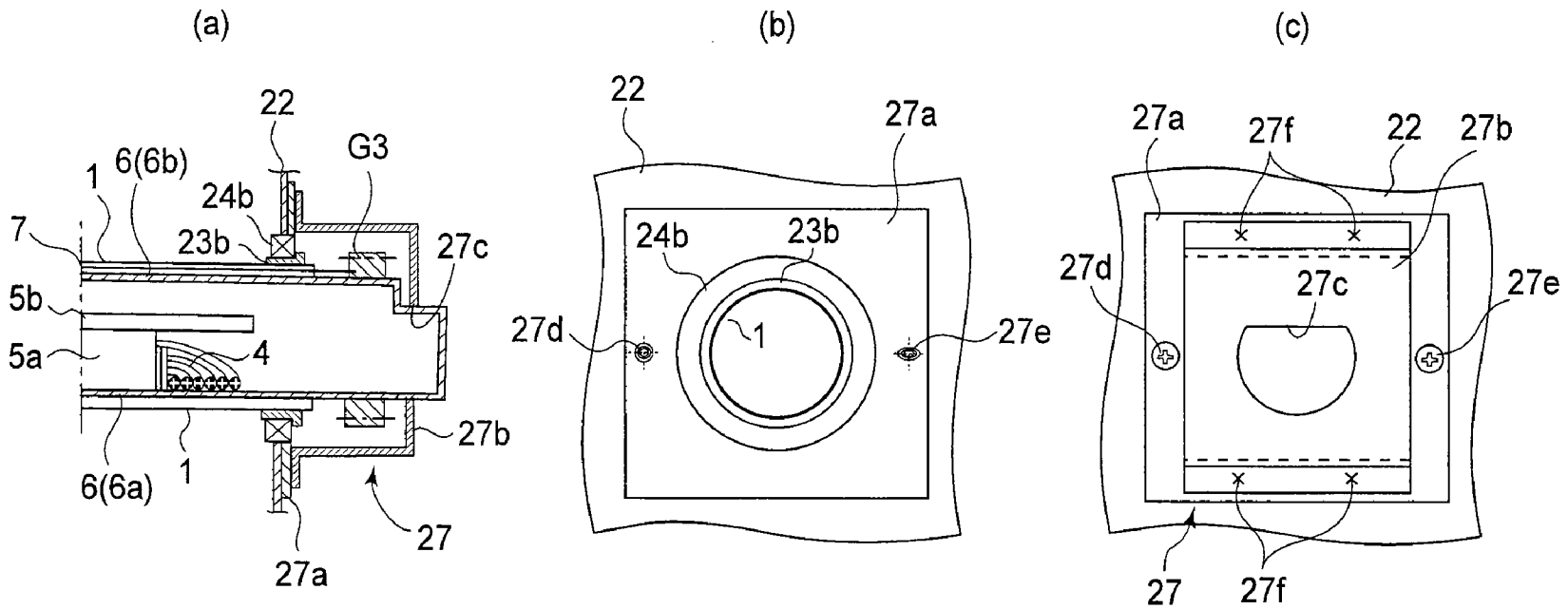
FIGS. 12(*a*), 12(*b*), and 12(*c*) are drawings showing a rear supporting member for supporting the fixation roller and the holder, by their rear end portions.
Figure 13:
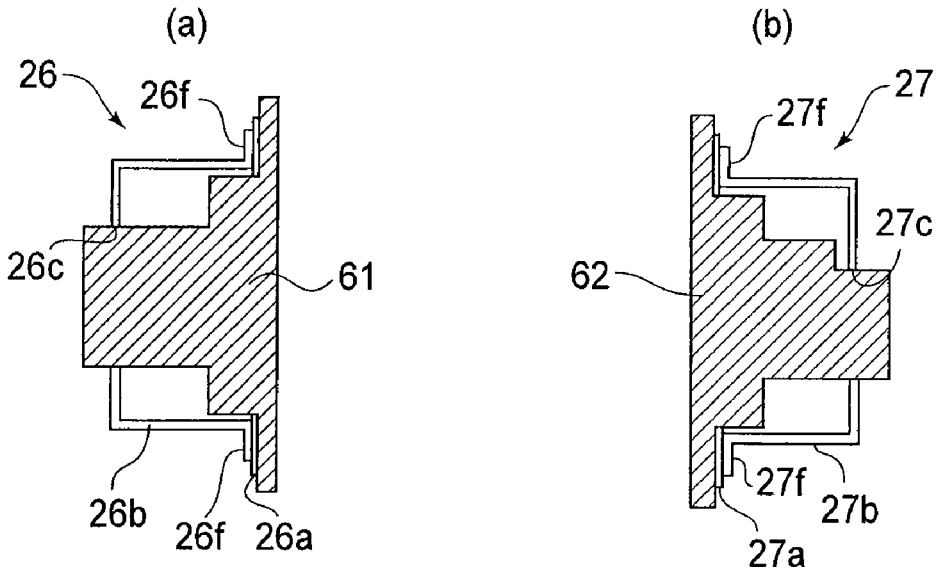
FIGS. 13(*a*) and 13(*b*) are drawings showing an auxiliary positioning means for positioning the front supporting member, and an auxiliary positioning means for positioning the rear supporting member.

Next, referring to FIGS. 12(*a*), 12(*b*), and 12(*c*), the rear supporting member 27 is also made up of two portions: first and second portions 27*a* and 27*b*. The first portion 27*a* is provided with a round hole for supporting the bearing 24*b* by the rear supporting member 27; the rear end portion of the fixation roller 1 is fitted in this hole, with the heat insulating bushing 23*b* placed between the fixation roller 1 and the bearing 24*b*. The second portion 27*b* of the rear supporting member 27 is provided with a D-shaped hole 27*c*, in which the rear end portion 6*d* of the holder 6, which is D-shaped in cross section, is fitted to prevent the holder 6 from rotating.

Further, the first and second portions 27*a* and 27*b* of the rear supporting member 27 are spot welded to each other at points 27*f*. As for the method for welding the two portions 27*a* and 27*b* to each other, the portions 27*a* and 27*b* are kept accurately positioned relative to each other with the use of a jig 62 as a means for facilitating the positioning of the portions 27*a* and 27*b* relative to each other, as shown in FIG. 13(*b*), and then, the two portions 27*a* and 27*b* are spot welded to each other. Therefore, it is possible to manufacture the rear supporting member 27 capable of coaxially holding the fixation roller 1 and holder 6 at a high level of accuracy, and also, holding the holder 6 at a predetermined angle, in terms of its circumferential direction, also at a high level of accuracy.

The rear supporting member 27 is attached to the rear plate 22 of the fixing apparatus with the use of small screws put through the roughly round hole and elongated hole located at positions 27*d* and 27*e*, respectively, and the corresponding holes of the rear plate 22, making it thereby possible to prevent the holder 6 from rotating relative to the rear plate 22 of the fixing apparatus.

The fixation roller 1 as a heat generation member and the holder 6 for supporting the exciting coil assembly 3 are supported by the front and rear supporting members 26 and 27, respectively. The fixation roller 1 is rotatably supported, whereas the holder 6 is nonrotationally supported. Since the fixing apparatus is structured so that the fixation roller 1 and holder 6 are coaxially supported, the fixation roller 1 and holder 6 are improved in the level of accuracy at which they are positioned relative to each other. Therefore, the fixation roller 1 and holder 6 can be more closely positioned relative to each other than it was possible in the past, improving therefore the efficiency with which the fixation roller 1 is heated by electromagnetic induction. Therefore, it is possible to reduce the fixing apparatus 100 in the length of time necessary for starting it up to a predetermined temperature level, substantially reducing thereby the fixing apparatus in energy consumption efficiency.

Further, the supporting member 26 for supporting the holder 6 (which is for holding the fixation roller 1 and exciting coil assembly 3) at one of the lengthwise ends of the holder 6 is rendered independent from the supporting member 27 for supporting the holder 6 at the other lengthwise end. Therefore, not only is it possible to maintain the positional relationship between the fixation roller 1 and holder 6 at a higher level of accuracy, but also, to improve the fixing apparatus in terms of the level of ease at which the fixation roller 1, and exciting coil assembly 3 as a magnetic flux generating means 3, can be replaced.

Further, the supporting member 26 is made up of two portions: first portion 26*a* provided with a portion for supporting the fixation roller 1, and second portion 26*b* separate from the first portion 26*a* and provided with a portion for supporting the holder 6 for supporting the exciting coil assembly 3. The supporting portion 27 is also made up of two portions: first portion 27*a* provided with a portion for supporting the fixation roller 1, and second portion 27*b* separate from the first portion 27*a* and provided with a portion for supporting the holder 6 for supporting the exciting coil assembly 3. Moreover, the first and second portions 26*a* and 26*b* of the first supporting members 26 are spot welded to each other while being kept precisely positioned relative to each other with the use of the jig 61 for precisely positioning the two portions 26*a* and 26*b*, and the portions 27*a* and 27*b* of the second supporting member 27 are spot welded to each other, with the use of the jig 62 for precisely positioning the two portions 27*a* and 27*b*. Therefore, not only can the fixation roller 1 be more precisely positioned relative to the holder 6, but also, the supporting members 26 and 27 are easier to manufacture.

Because of these effects of this embodiment described above, it is possible to position the fixation roller 1 substantially closer to the holder 6 for holding the exciting coil assembly 3 than in the past, making it possible to improve the fixing apparatus in terms of the level of efficiency at which heat is generated in the fixation roller 1 by electromagnetic induction. Further, it is possible to reduce the length of time (start-up time) necessary to increase the temperature of the fixation roller 1 to a predetermined level suitable for image fixation, drastically improving the fixing apparatus in terms of energy consumption efficiency.

In the case of the fixing apparatus in this embodiment, the internal diameter of the fixation roller 1 as a member in which heat is generated, is roughly 46 mm, and the exciting coil assembly 3 is disposed within the hollow of the fixation roller 1. The external diameter of the holder 6 for holding the exciting coil assembly 3 is roughly 40 mm. The holder 6 is roughly 40 mm in external diameter at both of its lengthwise ends, and roughly 400 mm in length. Thus, as the holder 6 is exposed to a temperature level of roughly 200° C. for an extended length of time, it sags across the center portion due to its own weight. When the magnetic flux adjusting member 7 is rotationally driven is in this state, the frictional resistance between the most sagging portion of the magnetic flux adjusting member 7 and the internal surface of the magnetic flux adjusting member 7 drastically reduces the magnetic flux adjusting member 7 in terms of the level of reliability at which it can be rotated to one of the afore-mentioned predetermined positions.

Figure 14:
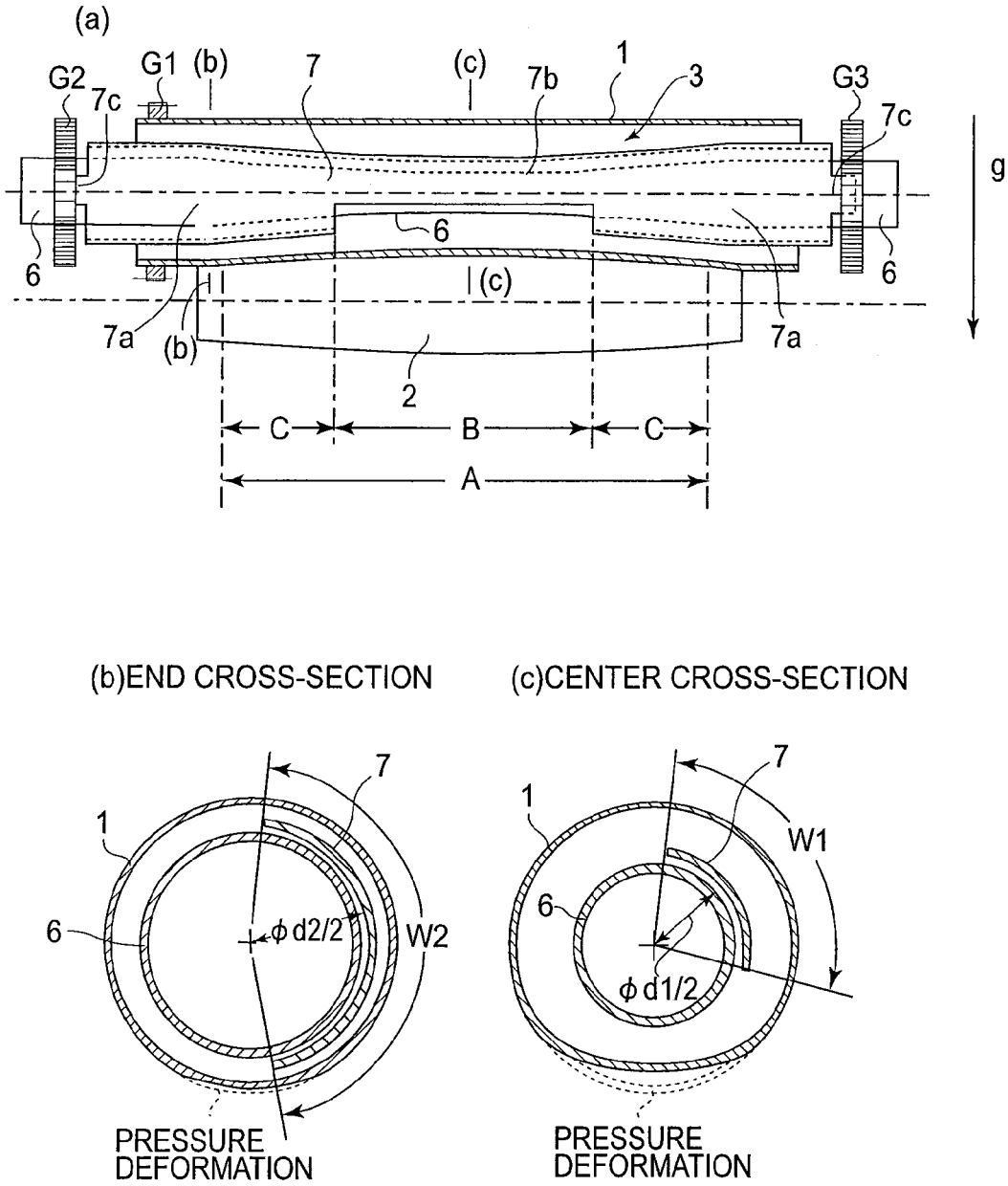
FIGS. 14(*a*), 14(*b*), and 14(*c*) are schematic drawings showing exaggeratedly the shape of the magnetic flux adjusting member, which resembles the shape of an inverted crown, and the deformations of the components adjacent to the magnetic flux adjusting member.

In this embodiment, therefore, the external diameter of the lengthwise central portion of the holder 6 is made to be roughly 38 mm even though it is roughly 40 mm at both of its lengthwise ends as exaggeratedly shown in FIGS. 14(*a*), 14(*b*), and 14(*c*). In other words, the holder 6 is given a shape similar to the shape of an inverted crown. Further, a direction indicated by an arrow g is a (downward) gravitation direction, so that the holder 6 has such a shape that a lower surface thereof in the gravitation direction is bent inwardly at least at the central portion in the longitudinal direction thereof when it is mounted in the fixing apparatus.

The holder 6 basically has a thickness on the order of 2.5 mm, so that the holder 6 is shaped to have a thickness on the order of 1.5 mm at the central portion, thus causing thickness deviation.

Alternatively, it is also possible to increase a distance between the vertical core 5*a* and the fixation roller 1 at the central portion by forming the holder in the reverse crown shape while keeping the basic thickness.

These shapes may appropriately selected depending on various conditions, thus not being a universal shape.

A distance between the fixation roller 1 and the holder 6 is 4 mm (in diameter) at the central portion. However, this value may vary depending on the material of the holder 6 and an amount of heat and/or an amount of sagging of the holder 6, thus being affected by a thermal strength represented by a thermal deformation temperature or the like of the material of the holder 6.

Generally, as the holder 6 has a larger thermal strength, the holder 6 has a higher unit material price. However, a degree of sagging due to thermal deformation of the holder 6 is smaller, so that stability in rotational movement of the magnetic flux adjusting member 7 is maintained.

On the other hand, as the holder 6 has a smaller thermal strength, the holder 6 has a larger degree of sagging due to thermal deformation. As a result, a degree of reverse crown is required to be larger in order to maintain the rotational movement stability of the magnetic flux adjusting member 7 but results in a large reduction in production costs.

For example, when a PPS material and a LCP material are compared, the LCP material is expensive about 3 times that of the PPS material in terms of a unit material price although it is not necessarily true since the price varies depending on an manufacturer, a filler, and an amount of the material.

In view of a balance between such a cost merit and an amount of perform design while first taking the rotational movement stability of the magnetic flux adjusting member 7 into consideration.

In order to decrease sliding (rubbing) resistance between the holder 6 and the magnetic flux adjusting member 7, a molding process which is called "embossing" is performed at a holder surface.

Figure 15:
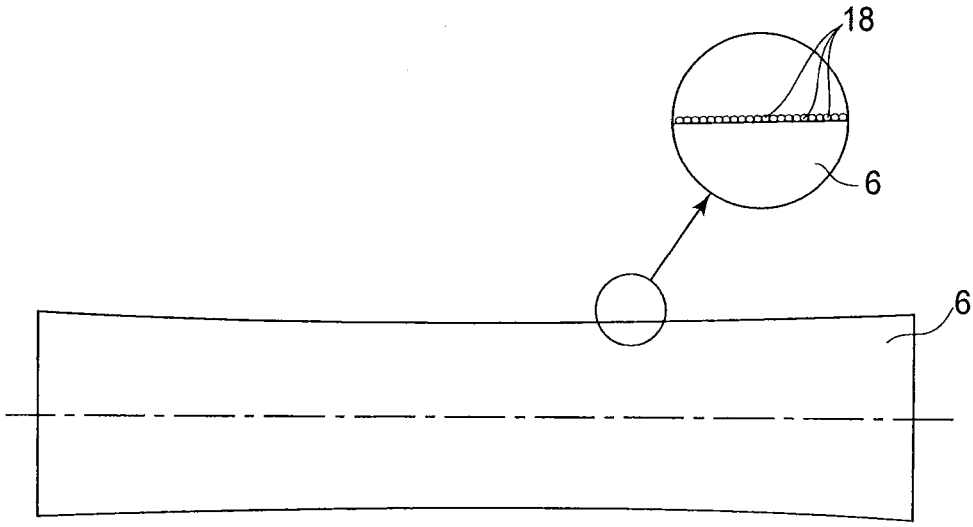
FIG. 15 is a view showing the holder and the surface thereof.

FIG. 15 shows a holder 6 and a partially enlarged portion at a surface of the holder 6.

As shown in FIG. 15, at the surface of the holder 6, a plurality of minute projections is provided. The embossing is also referred to as matting or frosting" and is ordinarily used for currently available resinous exterior components.

As an example of the above-described molding process, there is such a process that a chemical agent is applied onto a surface of a mold for shaping a resin (etching treatment) to increase a surface roughness of the surface, thus roughening the surface. The surface of a molded product prepared by the molding process has the same surface as the mold, thus losing luster to increase a quality appearance. In addition thereto, there is also a surface roughening process which is called a "sandblasting" wherein a small sand-like material is blown against the mold surface at high speed to roughen the mold surface.

The above-described two types of embossing processes have originally been used for increasing the quality appearance of the resinous exterior components but is used, in the present invention, for decreasing a contact area of the holder 6 with the magnetic flux adjusting member 7.

Figure 16:
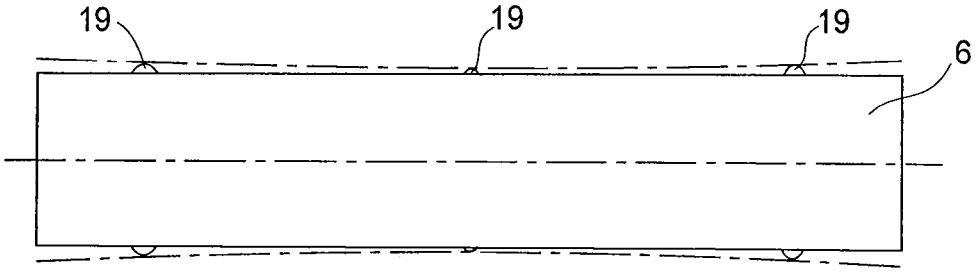
FIG. 16 is a view showing another embodiment of the holder.

Other than the embossing processes, as shown in FIG. 16, such a process that a plurality of minute projections 19 (three projections in this embodiment) is provided at a surface of the holder 6 in a longitudinal direction of the holder 6 so that an extended line connecting ends of these projections has a reverse crown shape is also effective in decreasing the contact surface. In this embodiment shown in FIG. 16, a central projection 19 having a predetermined height is provided at a central portion of the holder 6 and end projections 19 having a height larger than the predetermined height of the central projection are provided at end portions of the holder 6.

As a method of decreasing the contact area at the surface of the holder 6, other than the embossing processes, it is possible to provide a rib at the sliding surface of the holder 6 with the magnetic flux adjusting member 7. However, the addition of the rib results in an unnecessary increase in distance between the holder 6 (the core 5) and the magnetic flux adjusting member 7.

The holder 6 is rendered roughly circular in cross section, from one lengthwise end to the other. Giving this shape to the holder 6 makes it possible to continuously and stably rotationally move the fixation roller 1 since there is no contact portion between the holder 6 and the magnetic flux adjusting member 7. Further, by coaxially aligning the holder 6, fixation roller 1, and magnetic flux adjusting member 7, it is possible to improve their relative positional accuracy.

Basically, the magnetic flux adjusting member 7 is rendered roughly arcuate in cross section from one lengthwise end to the other, and the lengthwise end portions of the magnetic flux adjusting member 7 are rendered different from the central portion of the magnetic flux adjusting member 7, in the length of the arced portion, in terms of the circumferential direction of the fixation roller 1. That is, in terms of the circumferential direction of the fixation roller 1, the length w1 of the arced portion of the lengthwise central portion of the magnetic flux adjusting member 7 is rendered shorter than the length w2 of each of the lengthwise end portions of the magnetic flux adjusting member 7. As described above, the shutter gears G2 and G3 for driving the magnetic flux adjusting member 7 are fitted around the holder 6, and the magnetic flux adjusting member 7 is provided with the pair of protrusions 7*c* and 7*c*, which protrude from the lengthwise ends of the magnetic flux adjusting member 7. The pair of protrusions 7*c* and 7*c* are engaged with the shutter gears G2 and G3, one for one. Further, the shutter gears G2 and G3 are engaged with (fitted around) the holder 6 by the portions which are not engaged with the magnetic flux adjusting member 7. Therefore, the magnetic flux adjusting member 7 can be rotated by the gears G2 and G3, following the peripheral surface of the holder 6.

The portions of the holder 6, around which the shutter gears G2 and G3 are fitted one for one, are rendered uniform in external diameter across the portions largest in external diameter; they are not shaped like an inverted crown. Here, the expression that the portions of the holder 6, around which the gears G2 and G3 are fitted, one for one, and are the largest in external diameter, means that the holder 6 may be reduced in weight. With the employment of this structural arrangement, as the holder 6 and magnetic flux adjusting member 7 are engaged with the gears G2 and G3, they are coaxially disposed, making it possible to improve the image heating apparatus in terms of the level of accuracy at which these components are positioned relative to each other.

As described above, the holder 6 is shaped so that the relationship between an outer diameter $\phi d1$ of the central portion of the holder 6 and an outer diameter $\phi d2$ of each of the end portions of the holder 6, in terms of the lengthwise direction of the holder 6, that is, the direction perpendicular to the direction in which a material to be heated is conveyed, satisfies the following inequity: $\phi d1<\phi d2$. Therefore, contact between the holder 6 and the fixation roller 1 can be prevented or alleviated to provide an appropriate distance therebetween even when the holder 6 is bent by its own weight or thermally deformed. In addition thereto, in the case where such a constitution that the magnetic flux adjusting member 7 is moved in a gap between the holder 6 and the fixation roller 1 is adopted, it is possible to stably drive the magnetic flux adjusting member 7 by sagging of the holder 6.

Further, at least one of both end portions of the holder 6 having the outer diameter $\phi d2$ is provided with a straight-shaped portion with no change in maximum outer diameter, whereby the shape of the end portion of the magnetic flux adjusting member 7 can be ensured so that the magnetic flux adjusting member 7 can be readily engaged with the supporting member therefor. As a result, a relative positional relationship of the magnetic flux adjusting member 7 with the holder 6 and with the fixation roller 1 with high reliability.

The holder 6 has a plurality of projections 18 or 19 at the surface opposite to that the magnetic flux adjusting member 7 in the longitudinal direction, so that the magnetic flux adjusting member 7 is in point contact with the holder 6 through the projections 18 or 19. As a result, it is possible to decrease a sliding resistance between the holder 6 and the magnetic flux adjusting member 7.

Because of these effects of this embodiment described above, the magnetic flux adjusting member 7 can be appropriately rotationally moved according to two types of recording material sizes (large and small sizes), without causing operation failure. Moreover, this embodiment was effective to improve a fixing apparatus in the length of service life, in addition to the above described improvements related to performance. Thus, this embodiment made it possible to stabilize the rotational movement of the magnetic flux adjusting member 7 while obviating the operation failure. Therefore, it became possible to properly control the increase in the temperature of the fixation roller 1 across the portions corresponding to the areas outside the path of the recording material being conveyed through the fixing apparatus.

In the above-described embodiment, the holder 6 has a substantially circular cross section but the cross-sectional shape thereof may, e.g., be a semicircular shape.

(3) Miscellanies

Figure 17:
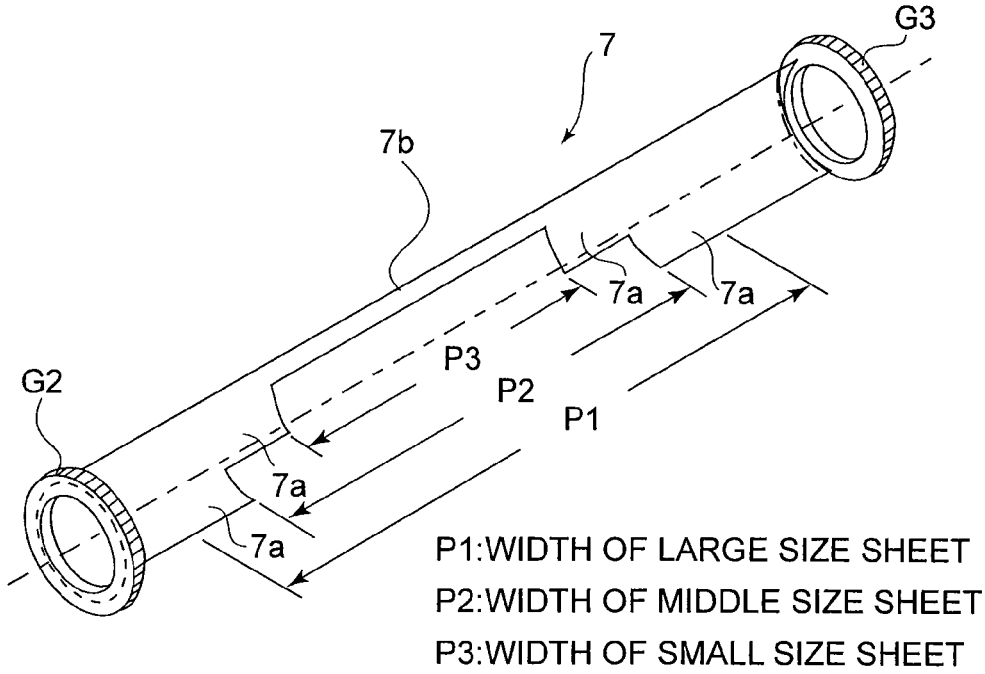
FIG. 17 is a schematic perspective view of the magnetic flux adjusting member given such a shape that enables it to accommodate three kinds of recording materials different in width (large, medium, and small sizes).

1) The fixing apparatus in this embodiment is structured to accommodate two kinds of recording mediums different in size: recording medium of a large size and recording medium of a small size. Thus, its magnetic flux adjusting member 7 is moved into the first switching position or second switching position according to the two recording medium sizes. However, this embodiment is not intended to limit the scope of the present invention. Obviously, a fixing apparatus may be structured so that its magnetic flux adjusting member is moved to one of three or more positions according to three or more recording medium sizes (widths). FIG. 17 is a schematic perspective view of a magnetic flux adjusting member 7 structured to accommodate three kinds of recording mediums different in width.

Figure 18:
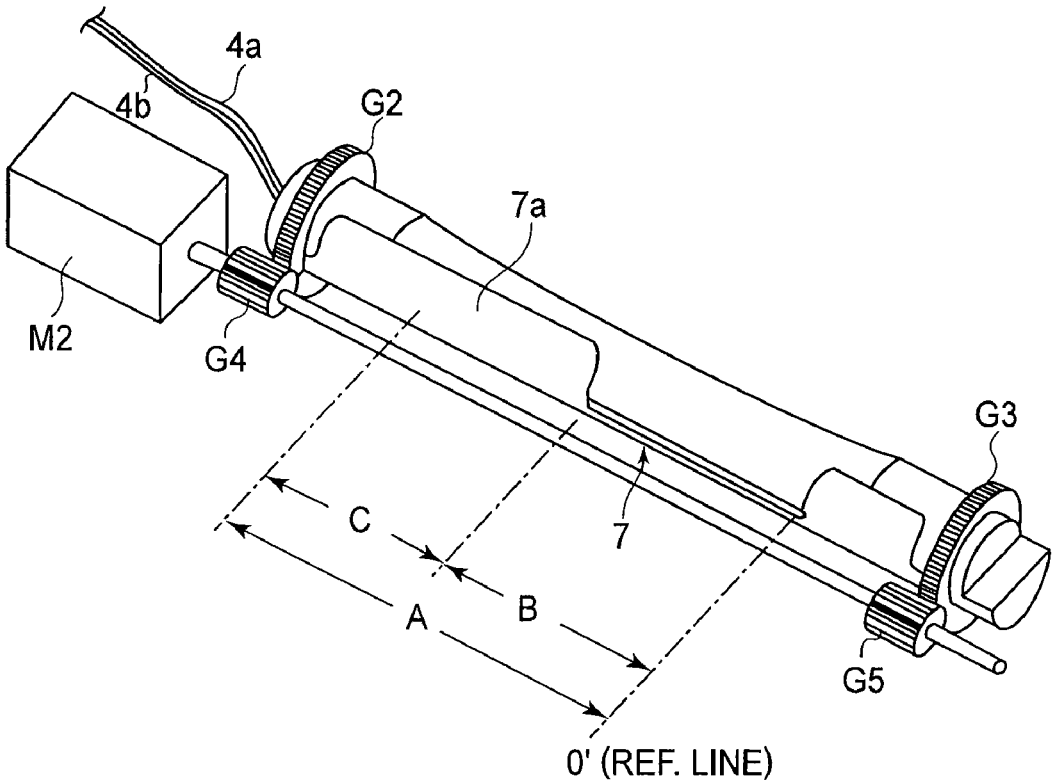
FIG. 18 is a schematic perspective view of an example of a magnetic flux adjusting member for a fixing apparatus in which a recording medium is conveyed while one of its lateral edges is kept aligned with the positional reference with which the apparatus is provided.
Figure 19:
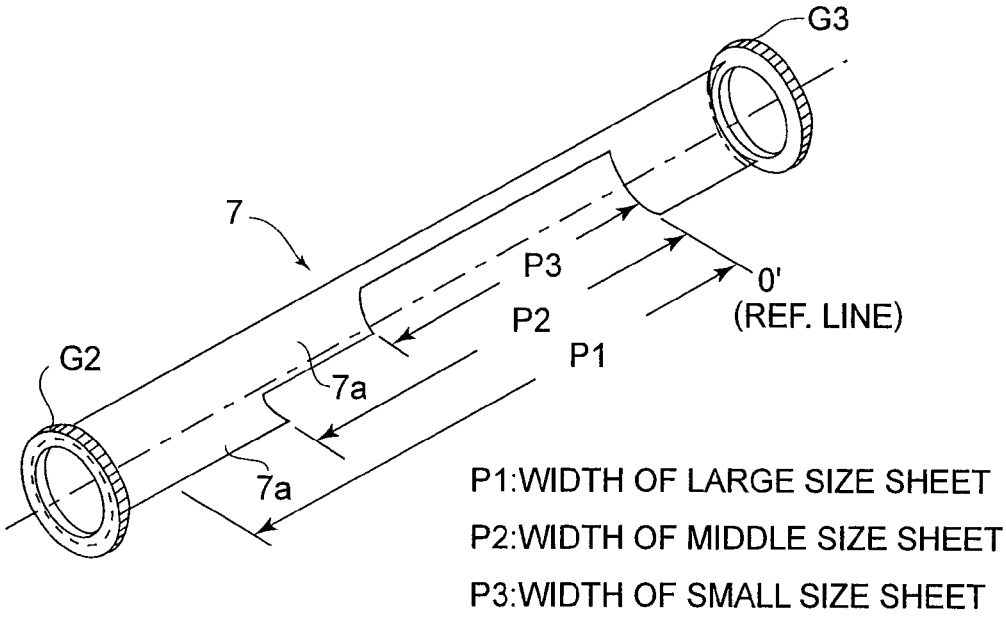
FIG. 19 is a schematic perspective view of another example of a magnetic flux adjusting member for a fixing apparatus in which a recording medium is conveyed while one of its lateral edges is kept aligned with the positional reference with which the apparatus is provided.

2) The fixing apparatus (image forming apparatus) is structured to convey a recording medium in such a manner that the centerline of the recording medium, in terms of the direction perpendicular to the recording medium conveyance direction, coincides with the lengthwise center of the fixation roller. However, the present invention is effectively applicable also to a fixing apparatus (image forming apparatus) structured to convey a recording medium in such a manner that one of the lateral edges of a recording medium is kept aligned with a referential line (member) with which the apparatus is provided. FIGS. 18 and 19 show the examples of the shape of the magnetic flux adjusting member for such an apparatus, that is, an apparatus in which the position of a recording medium relative to the apparatus, in terms of its width direction, is controlled with reference to only one of its lateral edges. The lines, in the two drawings, designated by a referential symbol O' are the referential lines for positioning a recording medium.

3) An image heating apparatus employing a heating method based on electromagnetic induction, to which the present invention is applicable, is not limited to the image heating apparatus in this embodiment. That is, the present invention is also applicable to an image heating apparatus such as an image heating apparatus for temporarily fixing an unfixed image to a recording medium, and an image heating apparatus for reheating a recording medium bearing a fixed image to change the fixed image in surface properties such as glossiness. Moreover, the present invention is effectively applicable to a heating apparatus for heating an object in the form a sheet, for example, a thermal pressing apparatus for removing wrinkles from an object in the form of a sheet, a thermal laminating apparatus, a thermal drying apparatus for evaporating water content from such an object as a sheet of paper, etc., which is obvious.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 063891/2005 filed Mar. 8, 2005, which is hereby incorporated by reference.

What is claimed is:

1. An image heating apparatus, comprising:

a coil for generating magnetic flux;

a rotatable heat generation member for generating heat by the magnetic flux generated by said coil to heat an image on a recording material;

a holder having an inner surface for supporting said coil while in contact with said coil, and having an outer surface outside the inner surface, said holder having a shape such that a central portion of the outer surface of said holder is more recessed than an end portion of said outer surface of said holder with respect to a rotational axis direction of said rotatable heat generation member; and a magnetic core, supported by said holder, for concentrating the magnetic flux.

2. An image heating apparatus according to claim 1, further comprising:

a magnetic flux decreasing member for decreasing the magnetic flux acting on said rotatable heat generation member by being inserted into a gap between said rotatable heat generation member and said holder; and drive means for driving said magnetic flux decreasing member.

3. An image heating apparatus according to claim 2, wherein said drive means is supported by said holder and comprises a gear to be connected to said magnetic flux decreasing member, and wherein said holder has a straight-shaped end portion to which the gear is configured to be connected.

4. An image heating apparatus according to claim 1, wherein said rotatable heat generation member is a hollow metal roller.

5. An image heating apparatus according to claim 4, wherein said holder is supported in said rotatable heat generation member.

6. An image heating apparatus according to claim 5, wherein the central portion of the outer surface of said holder and the end portion of the outer surface of said holder have a circular cross-sectional shape.

7. An image heating apparatus according to claim 1, further comprising:

a first side plate for supporting an end of said holder; and a second side plate for supporting another end of said holder, with respect to the rotational axis direction.

* * * * *